US008862001B2

(12) United States Patent
Okamoto

(10) Patent No.: US 8,862,001 B2
(45) Date of Patent: Oct. 14, 2014

(54) IMAGE FORMING APPARATUS WITH TONER IMAGE ALIGNMENT

(75) Inventor: Hideaki Okamoto, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 197 days.

(21) Appl. No.: 13/483,398

(22) Filed: May 30, 2012

(65) Prior Publication Data

US 2012/0308246 A1 Dec. 6, 2012

(30) Foreign Application Priority Data

Jun. 1, 2011 (JP) ..... 2011-123177

(51) Int. Cl.
*G03G 15/00* (2006.01)
*G03G 15/01* (2006.01)

(52) U.S. Cl.
CPC .... *G03G 15/5058* (2013.01); *G03G 2215/0129* (2013.01); *G03G 15/5041* (2013.01); *G03G 15/0189* (2013.01); *G03G 2215/0161* (2013.01); *G03G 15/5033* (2013.01); *G03G 15/0131* (2013.01)
USPC ..... 399/49

(58) Field of Classification Search
USPC ..... 399/38, 46, 49, 297–302, 388, 394
See application file for complete search history.

(56) References Cited

U.S. PATENT DOCUMENTS

| | | | | |
|---|---|---|---|---|
| 7,542,058 | B2 * | 6/2009 | Nishikawa et al. | 347/116 |
| 7,778,574 | B2 * | 8/2010 | Itagaki | 399/162 |
| 8,126,359 | B2 * | 2/2012 | Calamita et al. | 399/116 |

FOREIGN PATENT DOCUMENTS

| | | | |
|---|---|---|---|
| JP | 10-39571 | A | 2/1998 |
| JP | 2004-145077 | A | 5/2004 |
| JP | 2010-60761 | A | 3/2010 |

* cited by examiner

*Primary Examiner* — Hoan Tran
(74) *Attorney, Agent, or Firm* — Fitzpatrick, Cella, Harper & Scinto

(57) ABSTRACT

An image forming apparatus includes a first image bearing member, a second image bearing member, a developing device for forming a toner image on the basis of an electrostatic latent image formed on the first image bearing member, and an electrostatic latent image forming portion for forming an electrostatic latent image mark on the first image bearing member. In addition, a detecting portion detects a position of the electrostatic latent image mark, and an adjusting portion adjusts, on the basis of a detection result of the position of the electrostatic latent image mark, superposition between the toner image formed on the first image bearing member and the toner image formed on the second image bearing member. An electrostatic latent image which is undetectable by the detecting portion is formed between a formation region of the toner image on the first image bearing member and a formation region of the electrostatic latent image mark on the first image bearing member.

5 Claims, 17 Drawing Sheets

IMAGE FORMING APPARATUS WITH TONER IMAGE ALIGNMENT

FIELD OF THE INVENTION AND RELATED ART

The present invention relates to an image forming apparatus in which an electrostatic image for (positional) alignment formed outside an image region of an image bearing member is detected by a potential sensor to effect the alignment of a toner image in the image region. Specifically, the present invention relates to control for enhancing detection accuracy of the electrostatic image for the alignment by the potential sensor of a contact type.

An image forming apparatus in which a toner image is formed by developing with a toner an electrostatic image formed on an image bearing member and then is transferred onto a recording material to fix an image on the recording material under heat and pressure application has been widely used. In the image forming apparatus, a technique such that an electrostatic latent image for alignment is formed outside an image region of an image bearing member to effect alignment of the toner image to be formed in the image region of the image bearing member has been put into practical use. (Japanese Laid-Open Patent application (JP-A) Hei 10-39571).

In JP-A Hei 10-39571, in order to adjust timing of formation of electrostatic images for images on a plurality of photosensitive drums, in advance of image formation, electrostatic images for alignment are formed on the plurality of photosensitive drums and then are transferred onto the recording material conveyance belt.

In JP-A 2004-145077, in order to align the toner image on the photosensitive drum with the toner image for the image transferred onto the intermediary transfer belt in real time, a scale (code) pattern is magnetically recorded on a magnetic recording track of the intermediary transfer belt.

In JP-A 2010-60761, a contact (type) potential sensor capable of detecting electrostatic image scales formed on the photosensitive drum is described. The contact potential sensor is very small in size and in addition, outputs a detection signal of a differential waveform of a potential distribution on the detecting surface when the sensor passes through the electrostatic image scales, so that the contact potential sensor can precisely detect the positions of the electrostatic images.

As shown in FIG. 14, a contact potential sensor 330 detects an electrostatic image (131*b*) for alignment in a state in which a distance between a lead wire 331 and an image bearing member (112*b*) is kept constant by a thickness of a base film 332. For this reason, when a toner is deposited on the electrostatic image (131*b*) for alignment, the base film 332 flutters to fluctuate the distance between the lead wire 331 and the image bearing member (112*b*), so that a large noise is generated in a detection signal of the potential sensor 330 and thus it becomes difficult to effect normal alignment.

Further, as shown in FIG. 4, even when the electrostatic image 131*b* for alignment is formed outside a developing range (region), a toner in a small amount is scattered from the developing region to be detected on the electrostatic image 131*b* for alignment. The amount of the toner detected on the electrostatic image 131*b* for alignment is slight but the large noise is generated in the detection signal of the potential sensor 330.

Therefore, formation of the electrostatic latent image for alignment at a position considerably separated from an image region with respect to a main scan direction was proposed. However, in this case, the image bearing member larger than the image region is required, so that a cost of parts is increased and it becomes difficult to downsize the image forming apparatus.

SUMMARY OF THE INVENTION

A principal object of the present invention is to provide an image forming apparatus capable of reducing an amount of deposition of a toner on an electrostatic latent image scale.

According to an aspect of the present invention, there is provided an image forming apparatus, comprising: a first image bearing member; a second image bearing member; a developing device for forming a toner image on the basis of an electrostatic latent image formed on the first image bearing member; electrostatic latent image forming means for forming an electrostatic latent image mark on the first image bearing member; detecting means for detecting a position of the electrostatic latent image mark; and an adjusting portion for adjusting, on the basis of a detection result of the position of the electrostatic latent image mark, superposition between the toner image formed on the first image bearing member and the toner image formed on the second image bearing member; wherein an electrostatic latent image which is undetectable by the detecting means is formed between a formation region of the toner image on the first image bearing member and a formation region of the electrostatic latent image mark on the first image bearing member.

These and other objects, features and advantages of the present invention will become more apparent upon a consideration of the following description of the preferred embodiments of the present invention taken in conjunction with the accompanying drawings.

Figure 12:
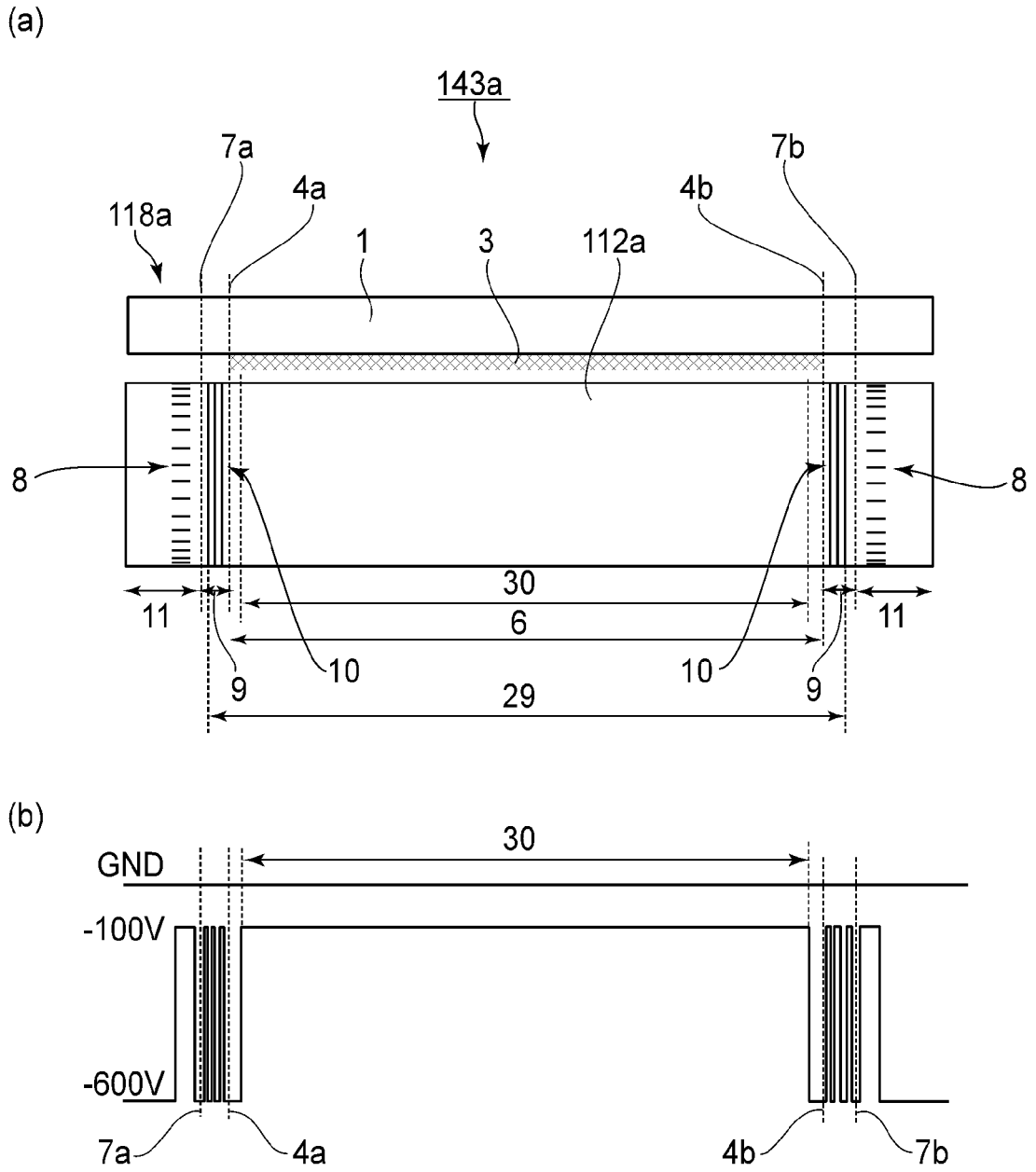

Parts (a) and (b) of FIG. 12 are illustrations of an image forming portion for writing (forming) an image position mark on the intermediary transfer belt.

Figure 13:
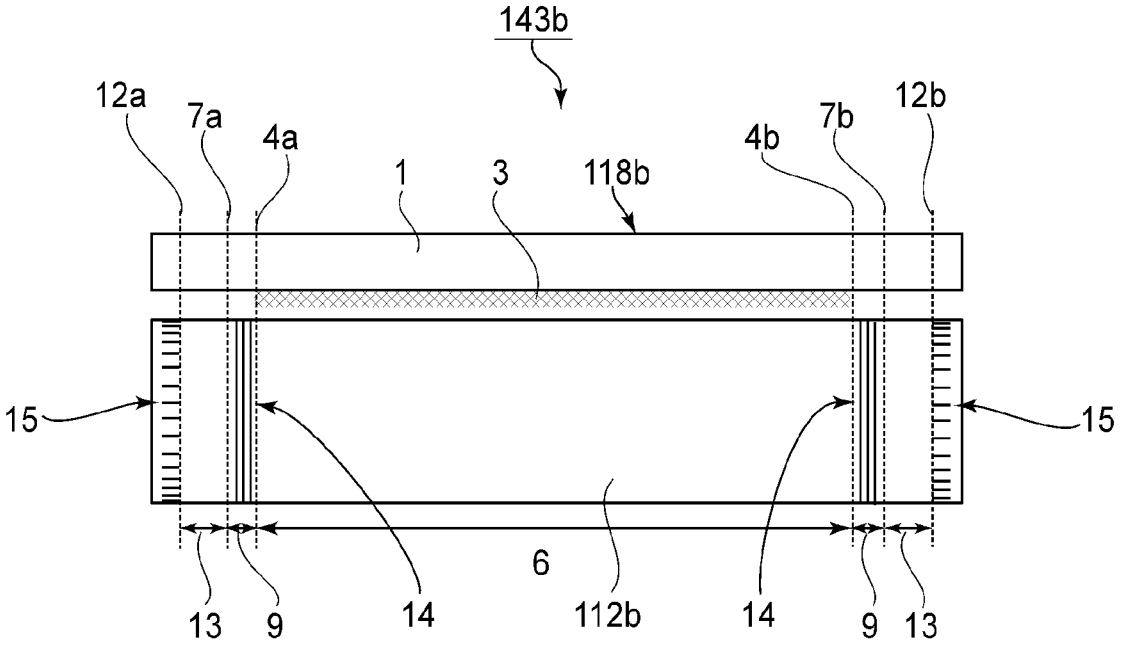

FIG. 13 is an illustration of a constitution of the image forming portion in which the image position mark is detected to effect alignment of a toner image.

Figure 14:
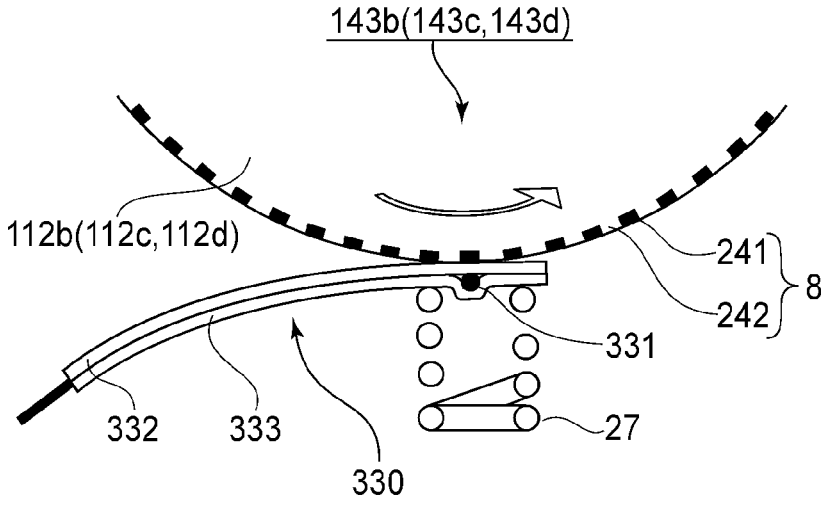

FIG. 14 is an illustration of reading of the image position mark on the develop.

Figure 15:
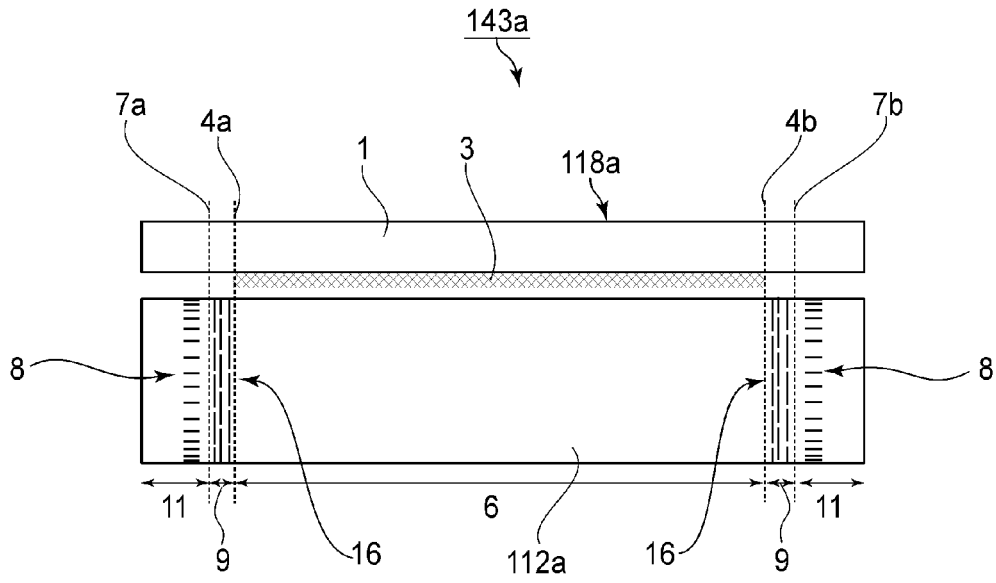

FIG. 15 is an illustration of a toner collection mark in Embodiment 2.

Figure 16:
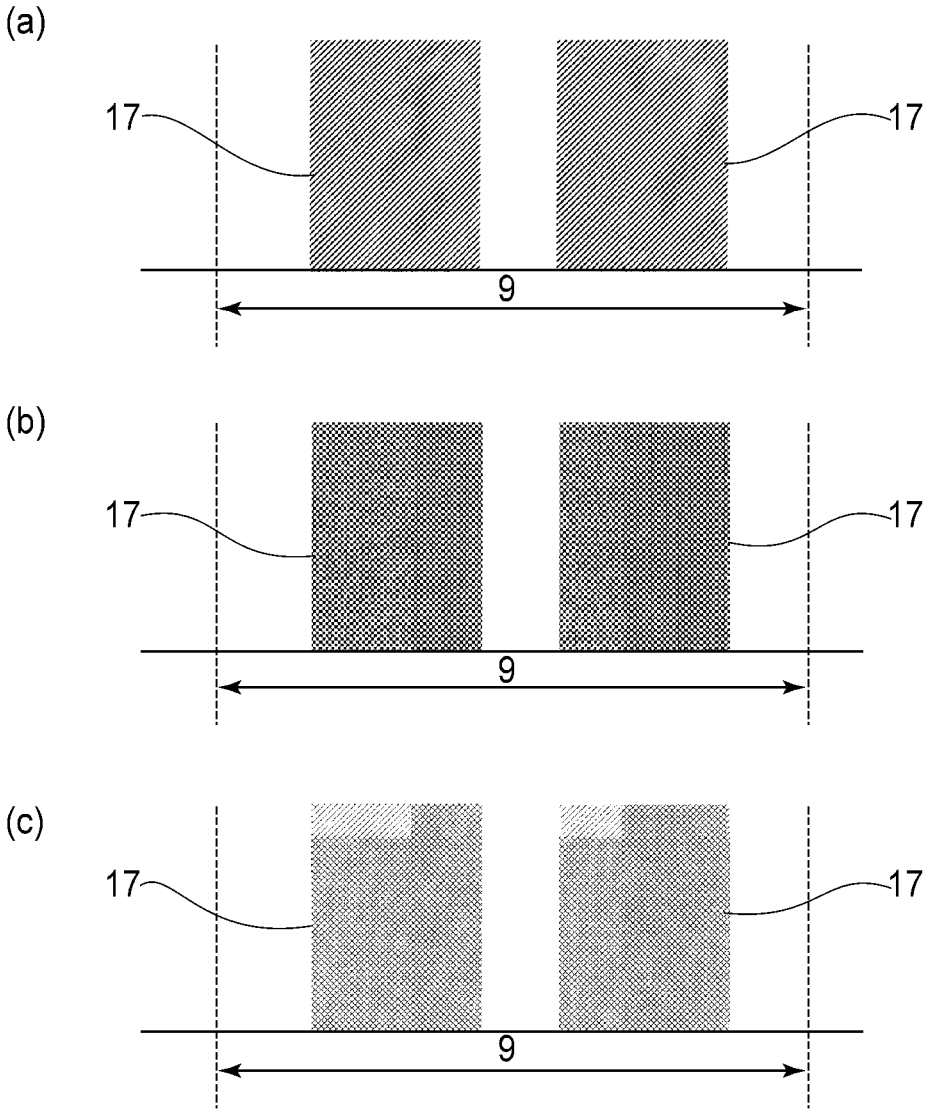

Parts (a) to (c) of FIG. 16 are illustrations of arrangement of the toner collection mark.

Figure 17:
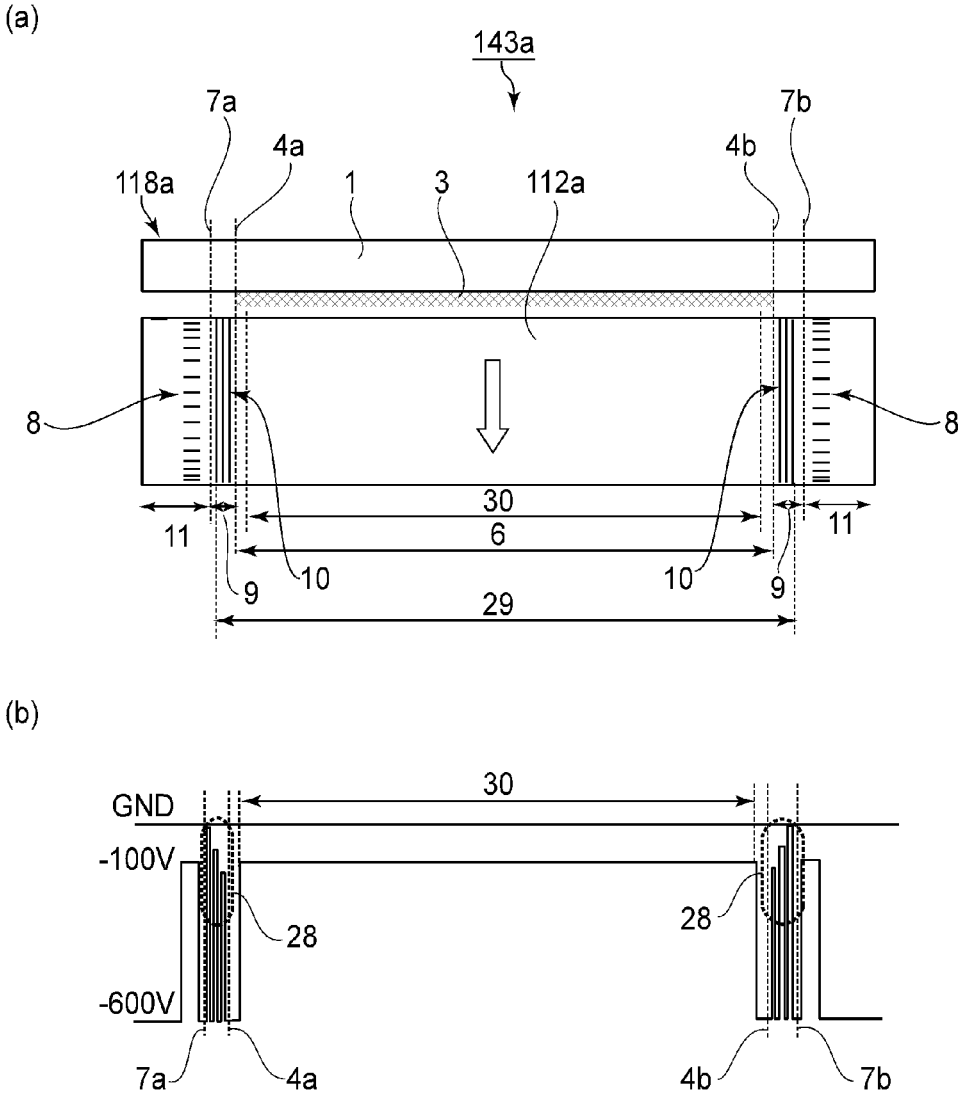

Parts (a) and (b) of FIG. 17 are illustrations of a toner collection mark in Embodiment 3.

Figure 18:
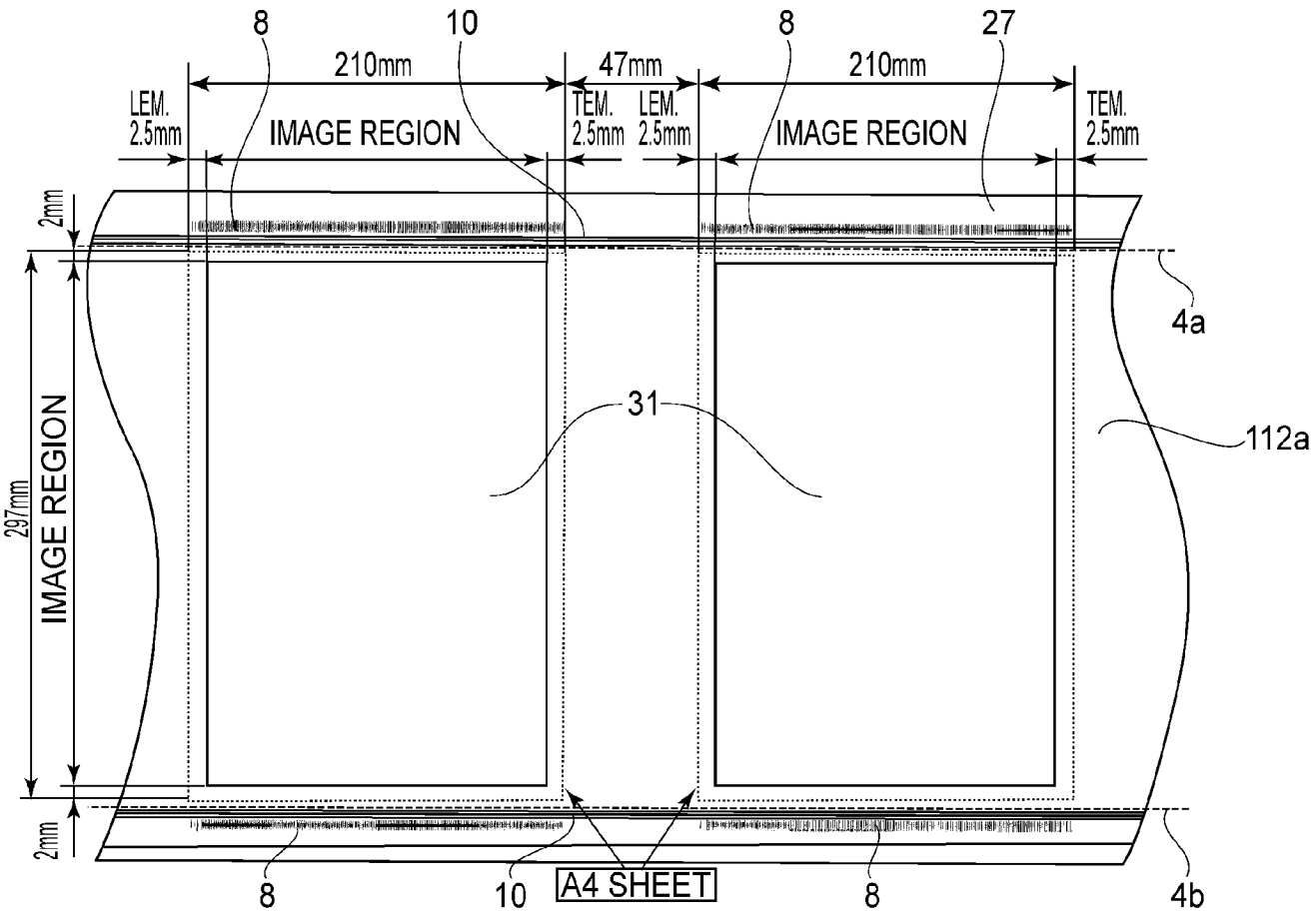

FIG. 18 is an illustration of arrangement of the toner collection mark on one-full-circumference of the photosensitive drum with respect to a sub-scan direction.

Figure 19:
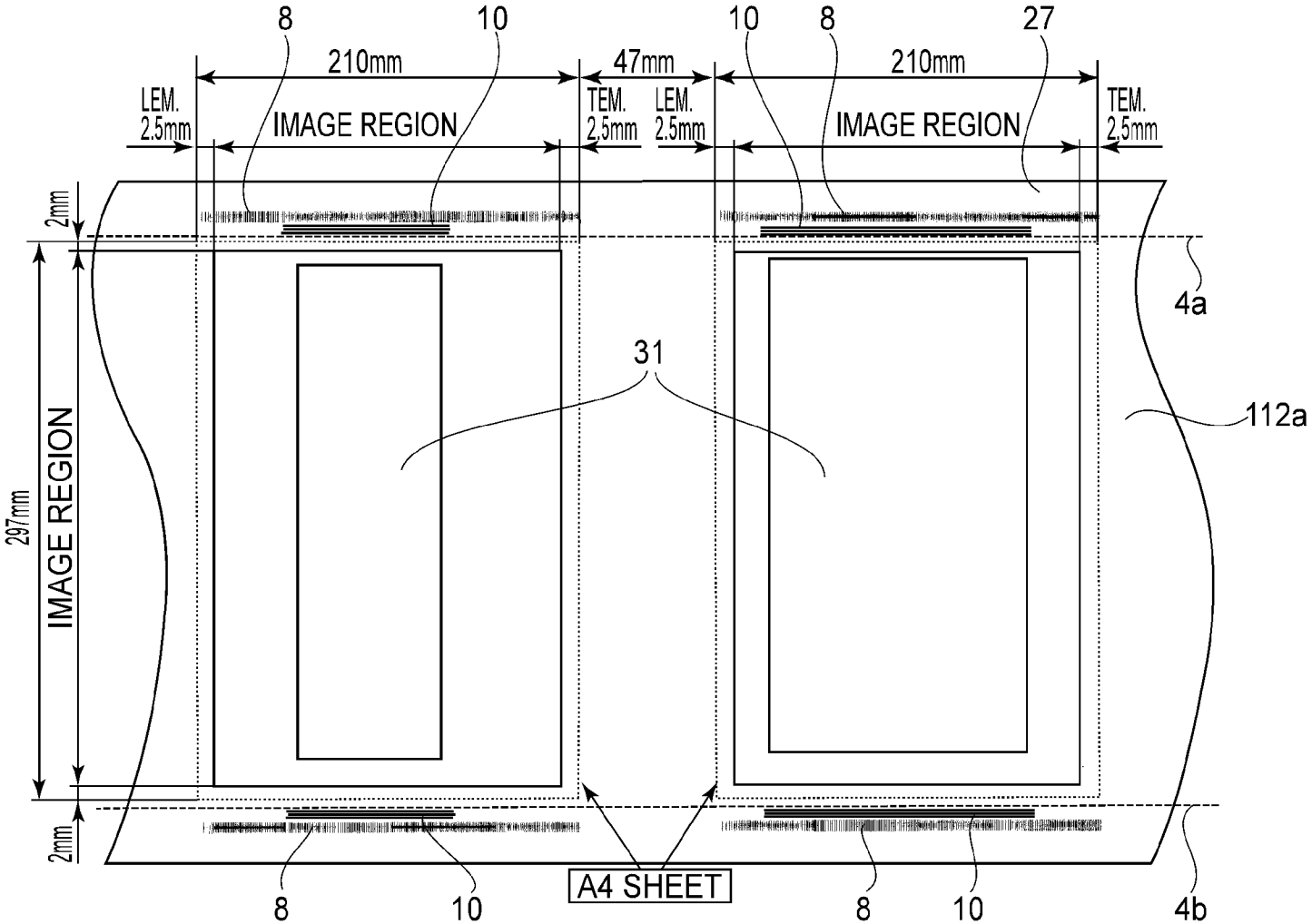

FIG. 19 is an illustration of arrangement of the toner collection mark associated with (corresponding to) a length of an effective image region with respect to the sub-scan direction.

Figure 20:
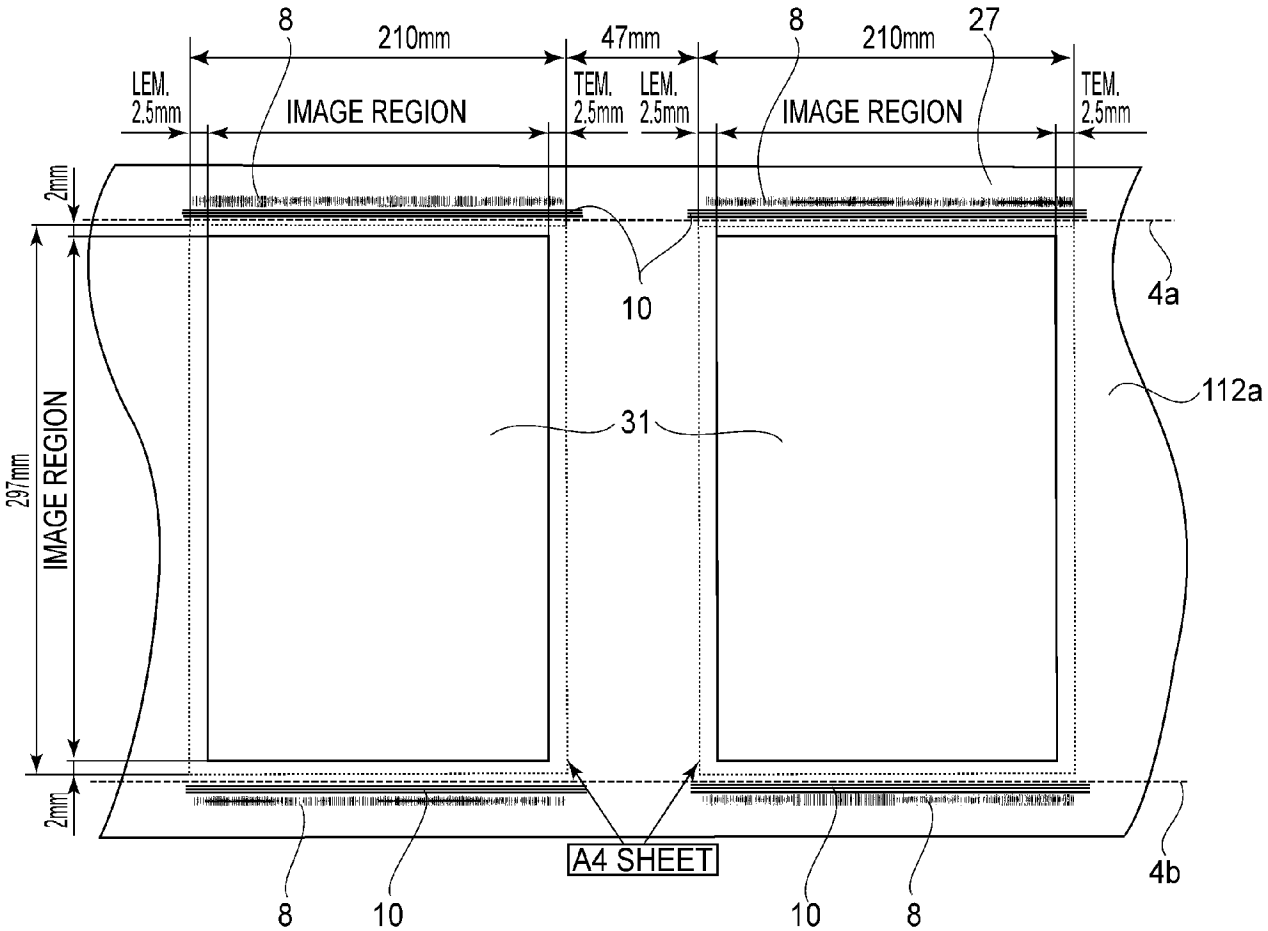

FIG. 20 is an illustration of arrangement of the toner collection mark associated with (corresponding to) a length of an first position mark with respect to the sub-scan direction.

DESCRIPTION OF THE PREFERRED EMBODIMENTS

Embodiments of the present invention will be described specifically with reference to the drawings.

<Image Forming Apparatus>

Figure 1:
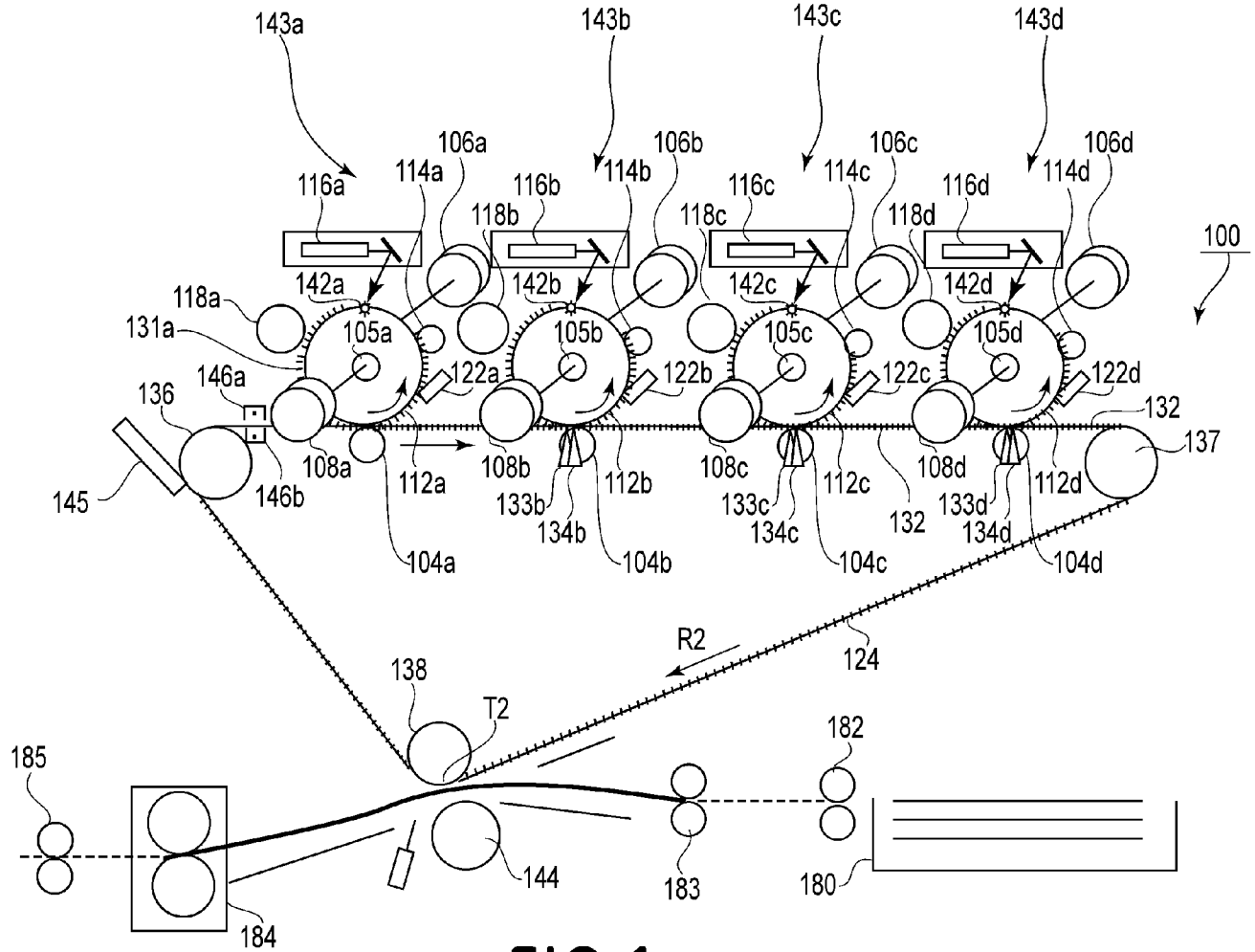
FIG. 1 is an illustration of a general structure of an image forming apparatus.

FIG. 1 is an illustration of a general structure of the image forming apparatus. As shown in FIG. 1, the image forming apparatus 100 is a full-color printer of the tandem type and of the intermediary transfer type, in which yellow, magenta, cyan and black image forming portions 143*a*, 143*b*, 143*c* and 143*d*, respectively, are arranged along an intermediary transfer belt 124. In this embodiment, a normal charge polarity of a toner of each of the colors is the same as a polarity of a surface potential of an electrostatic latent image.

In the image forming portion 143*a*, a yellow toner image is formed on a photosensitive drum 112*a*, and is transferred onto the intermediary transfer belt 124. In the image forming portion 143*b*, a magenta toner image is formed on a photosensitive drum 112*b*, and is transferred onto the intermediary transfer belt 124. In the image forming portions 143*c* and 143*d*, cyan and black toner images are formed on photosensitive drums 112*c* and 112*d*, respectively, and are transferred onto the intermediary transfer belt 124. After being transferred onto the intermediary transfer belt 124, the four toner images are conveyed to a second transfer portion T2 and then are secondary-transferred onto a recording material P.

The recording material P pulled out of a recording material cassette 180 is separated one by one by a separation roller 182 and then is conveyed to a registration roller 183, by which the recording material P is sent to a secondary transfer portion T2 and at the secondary transfer portion T2, the four color toner images are secondary-transferred onto the recording material P. The recording material P on which the toner images are secondary-transferred is conveyed to a fixing device 84. In the fixing device 184, the recording material P is subjected to heat and pressure, whereby the toner images are fixed and thereafter the recording material P is discharged to the outside of the image forming apparatus 100 by a discharging roller 185.

The intermediary transfer belt 124 is stretched around a tension roller 137, a belt driving roller 136 and an opposite roller 138 and to the intermediary transfer belt 124, a predetermined tension is applied by the tension roller 137. The belt driving roller 136 is rotationally driven by an unshown driving roller to rotate the intermediary transfer belt 124 in an arrow R2 direction at a predetermined process speed.

The image forming portions 143*a*, 143*b*, 143*c* and 143*d* have the same constitution except that the colors of the developers used by their developing apparatuses 118*a*, 118*b*, 118*c* and 118*d* are different from each other. In the following, the image forming portion 143*a* will be described. As for the image forming portions 143*b*, 143*c* and 143*d*, their descriptions are the same as the description of the image forming portion 143*a* except that the suffix "a" of reference numerals or symbols of constituent members of the image forming portion 43*a* is replaced with b, c and d, respectively.

The image forming portion 143*a* includes a charging roller 114*a*, an exposure device 116*a*, a developing device 118*a*, a primary transfer roller 104*a*, and a drum cleaning device 122*a*, which are disposed at the periphery of the photosensitive drum 112*a*.

The photosensitive drum 112*a* is prepared by forming a 30 μm-thick photosensitive layer having a negative charge polarity on an outer peripheral surface of an aluminum cylinder and is rotated in a direction indicated by an arrow R1 at a predetermined process speed. The charging roller 114*a* is supplied with an oscillating voltage in the form of a DC voltage biased with an AC voltage, so that the surface of the photosensitive drum 112*a* to a uniform negative dark-portion potential VD (−600 V).

The exposure device 116*a* as an example of first to third electrostatic image forming means writes the electrostatic image for the image by lowering the dark-portion potential VD of the photosensitive drum 112*a* to a light-portion potential VL (about −100 V). The developing device 118*a* develops the electrostatic image with a two-component developer containing a toner and a carrier, thus forming the toner image on the photosensitive drum 112*a*. At the exposed portion of the light-portion potential V1, the yellow toner is deposited and the electrostatic image is reversely developed into the yellow toner image.

The primary transfer roller 104*a* urges the inner surface of the intermediary transfer belt 124 to form a transfer position Ta between the photosensitive drum 112*a* and the intermediary transfer belt 124. By applying a positive DC voltage (about +1000 V) to the primary transfer roller 104*a*, the toner image is primary-transferred from the photosensitive drum 112*a* onto the intermediary transfer belt 124.

The drum cleaning device 122*a* slides a cleaning blade on the surface of the photosensitive drum 112*a* to collect transfer residual toner remaining on the surface of the photosensitive drum 112*a* without being transferred onto the intermediary transfer belt 124. A belt cleaning device 145 slides a cleaning blade on the surface of the intermediary transfer belt 124, supported by a belt driving roller 136 at the inner surface of the intermediary transfer belt 124, to collect from the surface of the intermediary transfer belt 124 the transfer residual toner passing through the secondary transfer portion T2.

To the photosensitive drum 112*a*, a driving force is transmitted via a driving system for transmitting the driving force from a drum driving motor 106*a* to a drum rotation shaft 105*a*. To the drum rotation shaft 105*a*, a drum encoder 108*a* is connected. At the image forming portion 143*a*, based on an output signal from the drum encoder 108*a*, the drum driving motor 106*a* is rotated, so that the photosensitive drum 112*a* is controlled so as to rotate in the arrow direction at the same angular speed.

On the other hand, the photosensitive drums 112*b*, 112*c* and 112*d* are, as described later, adjusted in rotational speed in real time on the basis of a detection signal of an electrostatic image scale 132 which have electrostatic image scale lines 131*a* formed on the photosensitive drum 112*a* and then is transferred onto the intermediary transfer belt 124. As a result, with the toner image for the image formed on the photosensitive drum 112*a* and then transferred on the intermediary transfer belt 124, the toner images for the image on the photosensitive drums 112*b*, 112*c* and 112*d* are positionally aligned and then are superposed.

Corona chargers 146*a* and 146*b* are disposed so as to sandwich the charge receiving portion 125 of the intermediary transfer belt 124. By applying AC voltages of opposite phases between the corona chargers 146*a* and 146*b*, the electrostatic image scale lines 131*a* which are formed on the photosensitive drum 112*a* and then are transferred onto the charge receiving portion 124 of the intermediary transfer belt 124 to be used for the toner image superposition control are erased with reliability.

As a constitution for electrically discharging the charge receiving portion 125 of the intermediary transfer belt 124, a discharging brush which is contacted to the charge receiving portion 125 and is connected to the ground potential may also be disposed.

The image forming apparatus 100 includes the plurality of the image forming portions 143*a*, 143*b*, 143*c* and 143*d* for speed-up, in which the toner images different in color (yellow, magenta, cyan and black) are successively transferred onto the intermediary transfer belt 124.

However, the image forming apparatus causes, due to a mechanical accuracy or the like, speed fluctuations of the plurality of the photosensitive drums 112*a*, 112*b*, 112*c* and 112*d* and the intermediary transfer belt 124 and meandering of the intermediary transfer belt 124. As a result, at the transfer positions of the image forming portions 143*a*, 143*b*, 143*c* and 143*d*, a difference or the like of movement amount (distance) is independently (separately) generated in every color belt on the photosensitive drum outer peripheral surface and the intermediary transfer belt 124. For this reason, when the toner images are superposed, the toner images are not aligned with each other, so that there is a possibility of an occurrence of color misregistration (positional deviation) of 100-150 μm among the color toner images.

Therefore, the image forming apparatus 100 transfers the electrostatic images onto the charge receiving portion 125 on the intermediary transfer belt 124 and corrects an image deviation by detecting positions of the electrostatic images.

<Charge Receiving Portion>

Figure 2:
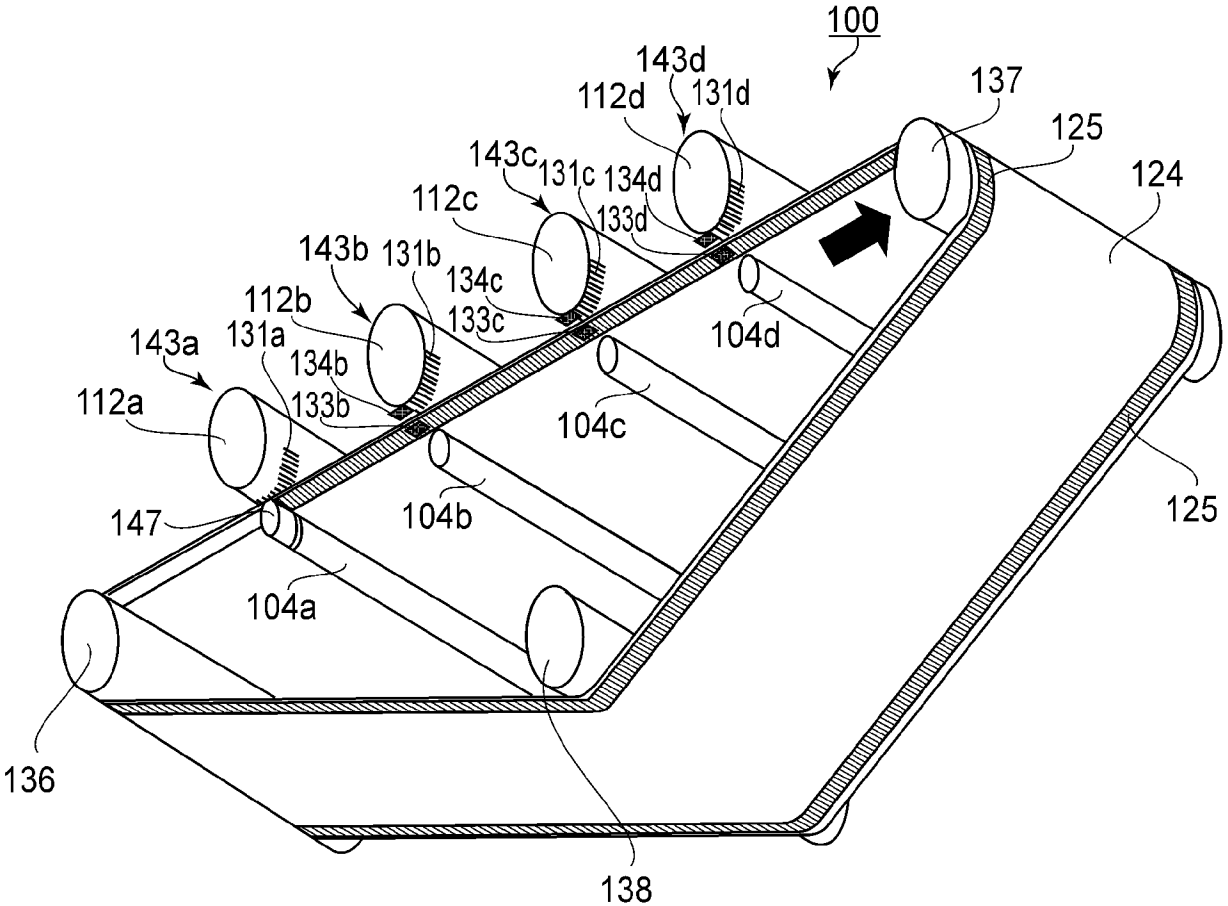
FIG. 2 is an illustration of arrangement of an electric charge receiving (transfer) portion.

FIG. 2 is an illustration of arrangement of the charge receiving portion. As shown in FIG. 2, the charge receiving portion 125 is prepared by bonding a 0.05 nm-thick PET film, formed in a tape shape of 5 mm in width by a material of a volume resistivity of $10^{14}$ Ωcm or more, to an outer surface of the intermediary transfer belt 124 at both end portions of the intermediary transfer belt 124. With respect to the material for the charge receiving portion 125, when the material has the volume resistivity of $10^{14}$ Ωcm or more and can be bonded to the intermediary transfer belt 124, the material is not limited to films of PET, fluorine-containing resin such as PTFE, polyimide or the like. The charge receiving portion 125 may also be prepared by partly forming a high-volume resistivity region through application or coating by spraying or the like of the material such as the fluorine-containing resin of PTFE or the polyimide.

The charge receiving portion 125 is constituted by the material of $10^{14}$ Ωcm in volume resistivity. The charge receiving portion 125 is provided on the front (upper) surface of the intermediary transfer belt 124 and onto which the electrostatic latent image scale lines 131*a* are transferred in a state in which the surface of the charge receiving portion 125 is contacted to the photosensitive drum 112*a*. The charge receiving portion 125 is constituted by a high-resistance material of $10^{14}$ Ωcm or more and therefore electric charges transferred on the charge receiving portion 125 are held without being moved, and thus functions as the belt scale (electrostatic image scale) 132 to be conveyed toward a downstream side. The electric charges on the surface of the photosensitive drum 112 are transferred onto the charge receiving portion 125 and are used as the belt scale 132.

On the other hand, the intermediary transfer belt 124 is constituted by a medium-resistance material of $10^{9}$-$10^{10}$ Ωcm in volume resistivity in order to maintain a transfer performance of the toner images. In the case of the intermediary transfer belt 124 constituted by the material $10^{10}$ Ωcm or less in volume resistivity, when the electrostatic latent image scale lines 131*a* are contacted to the intermediary transfer belt, the electric charges are transferred. However, the intermediary transfer belt 124 has a small resistance value and therefore the electric charges are quickly diffused, so that the belt scale 132 cannot be maintained by the intermediary transfer belt 124 itself. For this reason, in a constitution in which the toner images are transferred onto the intermediary transfer belt 124 and then are secondary-transferred onto the recording material, the charge receiving portion 125 of the material having the volume resistivity different from and higher than that of the intermediary transfer belt 124 is bonded to the intermediary transfer belt 124.

At the image forming portions 143*b*, 143*c* and 143*d*, with the belt scale 132 corresponding to the toner image transferred at the image forming portion 143*b*, positions of the electrostatic latent image scale lines 131*b*, 131*c* and 131*d* corresponding to the toner images are aligned. As a result, at the image forming portions 143*b*, 143*c* and 143*d*, it becomes possible to superposedly transfer the toner images onto the toner image transferred on the intermediary transfer belt 124, so that a color toner image free from the color misregistration can be obtained.

<Transfer Roller>

The primary transfer roller 104*a* is constituted by an electroconductive sponge roller which has a diameter of about 16 mm and is formed of an electroconductive sponge at its surface. The primary transfer roller 104*a* is connected to an unshown high voltage source and is capable of transferring the toner image from the photosensitive drum 112 onto the intermediary transfer belt surface by attracting the toner image through an electrostatic force.

At both ends of the primary transfer roller 104*a*, belt scale transfer rollers 147 are provided. On the surface of the intermediary transfer belt 124 at the both end portions, the charge receiving portions 125 are provided and at a (back or lower) surface opposite from the side where the charge receiving portion 125 is present, the belt scale transfer rollers 147 are disposed. Each belt scale transfer roller 147 is constituted by the electroconductive sponge alignment similarly as the primary transfer roller 104*a*. To the belt scale transfer roller 147, a high voltage different from the high voltage applied to the primary transfer roller 104*a* is applied. The electric charges forming the electrostatic latent image scale lines 131*a* are transferred onto the charge receiving portion 125 by the belt scale transfer roller 147 under an optimum transfer condition different from the toner image transfer condition. The optimum transfer condition for the transfer of the electrostatic latent image scale lines 131*a* varies depending on an environment fluctuation or the like similarly as in the case of the toner image transfer but is different from that for the toner image transfer.

<Writing of Belt Scale>

Figure 3:
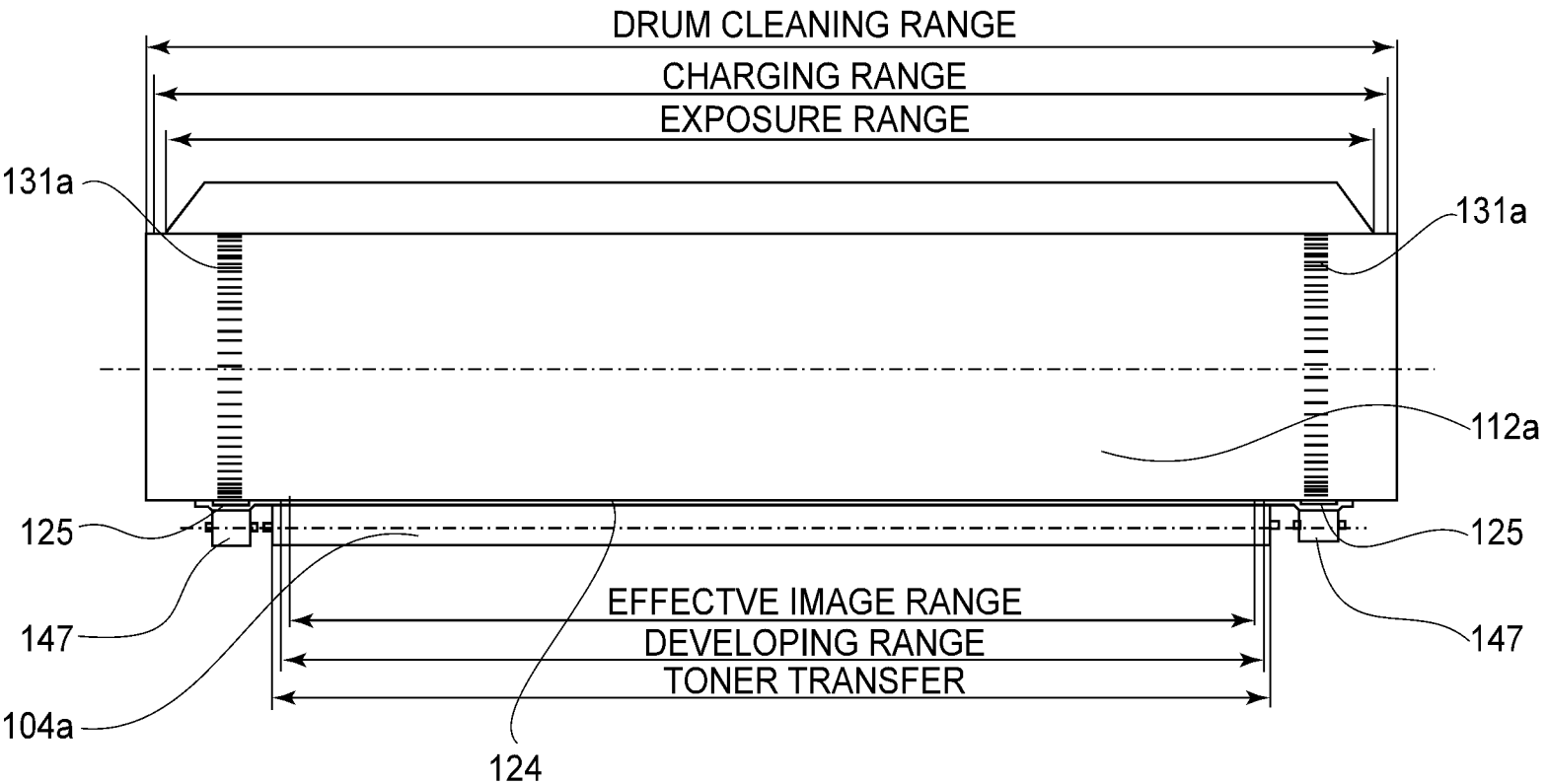
FIG. 3 is an illustration of a constitution for transferring an electrostatic image (electrostatic latent image) scale onto an intermediary transfer belt.

FIG. 3 is an illustration of a constitution for transferring the electrostatic image scale onto the intermediary transfer belt. As shown in FIG. 1, at each of positions extended from an exposure position 142*a* of the photosensitive drum 112*a*, the exposure device 116*a* writes (forms) the electrostatic latent image scale lines 131*a* by laser light irradiation before or after the image writing. At the image forming portion 143*a* which is an example of a toner image forming portion, the toner image is transferred in a side upstream of the photosensitive drum 112*b* with respect to a rotational direction of the intermediary transfer belt and at the same time, the belt scale 132 which is an example of an electrostatic image index is written (formed) on the intermediary transfer belt 124.

As shown in FIG. 3, the charge receiving portion 125 is provided at a position, corresponding to the electrostatic latent image scale lines 131*a* formed on the photosensitive drum 112*a*, on the surface of the intermediary transfer belt 124 at both end portions. The electrostatic latent image scale lines 131*a* are contacted to the charge receiving portion 125. By applying a high voltage of about +500 V to the belt scale transfer roller 147, a part of electric charges forming the electrostatic latent image scale lines 131*a* is transferred onto the charge receiving portion 125. Thus, the belt scale 132 with the same pitch as that of the electrostatic latent image scale lines 131*a* is formed.

At this time, a potential difference between the belt scale transfer roller 147 and the exposed portion of the photosensitive drum 112*a* where the electrostatic latent image scale lines 131*a* are formed is about 600 V. On the other hand, a potential difference between the belt scale transfer roller 147 and the non-exposed portion of the photosensitive drum 112*a* between the electrostatic latent image scale lines 131*a* is about 1100 V. By the difference between these potential differences, a state of electric discharge between the photosensitive drum 112 and the intermediary transfer belt 124 or between the intermediary transfer belt and the primary transfer roller 104 is changed, so that the electrostatic latent image scale 132 is transferred onto the intermediary transfer belt 124.

In this case, it is known from an experiment that the surface potential at the charge receiving portion 125 after the transfer is about +400 V at the latent image formation portion irradiated with the laser light and is about +300 V at a portion which is not irradiated with the laser light. That is, the scale based on the difference in surface potential on the photosensitive drum 112*a* between −600 V and −100 V is transferred as the scale based on the surface potential on the intermediary transfer belt 124 between +400 V and +300 V.

The electrostatic latent image scale lines 131*a* are written at positions of the both end portions outside an effective image region where the toner image is formed. The electrostatic latent image scale lines 131*a* are formed immediately after start of the rotational drive of the photosensitive drum 112*a* before the image is written (formed) on the photosensitive drum 112*a* and is continuously written until the image formation on the photosensitive drum 112*a* is ended.

A length of the electrostatic latent image scale lines 131*a* is about 5 mm with respect to an axial direction of the photosensitive drum 112*a*. A width of the electrostatic latent image scale lines 131*a* is, in the case where a dissolution of the image with respect to the sub-scan direction is 1200 dpi, obtained from 25.4/1200×2=0.0423333 . . . (mm), so that a pitch of 42.3 μm is a minimum unit. However, in this embodiment, in view of an allowance of anti-noise property, the electrostatic latent image scale lines 131*a* are formed in an incremental pattern of 4 lines and 4 spaces and therefore the electrostatic latent image scale lines 131*a* are formed with a pitch of 42.3 μm×8=338.4 μm.

<Belt Scale Reading>

Figure 4:
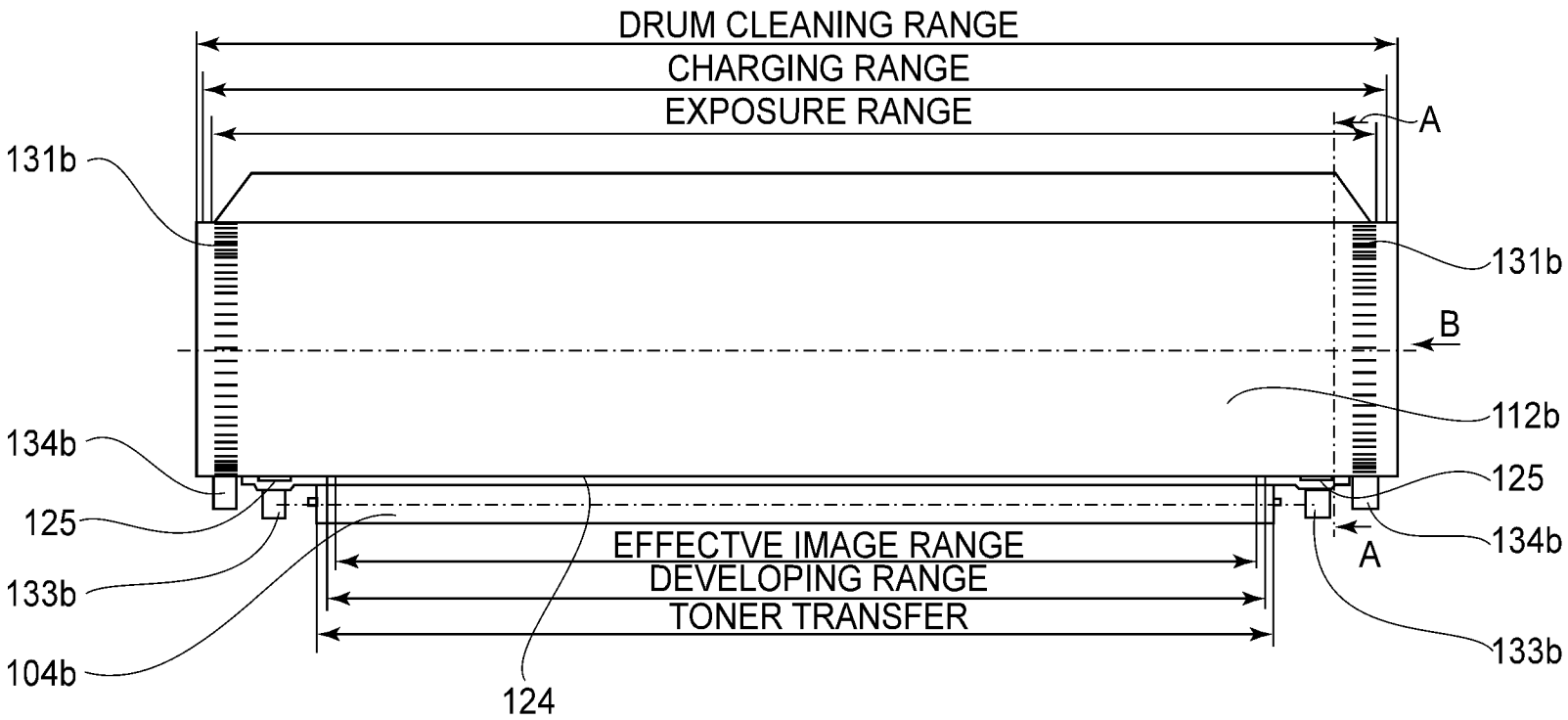
FIG. 4 is illustration of a constitution for detecting the electrostatic image scale transferred on the intermediary transfer belt.

FIG. 4 is an illustration of a constitution for detecting the electrostatic latent image scale transferred onto the intermediary transfer belt. As shown in FIG. 2, the image forming portions 143*b*, 143*c* and 143*d* have the same constitution and are controlled in the same manner and therefore in the following, the image forming portion 143*b* is described and the image forming portions 143*c* and 143*d* will be omitted from redundant explanation.

As shown in FIG. 1, the exposure device 116*b* which is an example of the electrostatic image forming means is capable of forming the electrostatic image with respect to the main scan direction on the photosensitive drum 112*b* which is an example of the image bearing member rotating in the sub-scan direction. The developing device which is an example of the developing means develops with a toner the electrostatic image, for an image, which is an example of a first electrostatic image formed in an image region of the photosensitive drum 112*b* by using the exposure device 116*b* to form the toner image.

As shown in FIG. 4, the intermediary transfer belt 124 which is an example of a belt member is disposed in contact to the photosensitive drum 112*b* while the electrostatic image is holdably formed thereon. The primary transfer roller 104*b* which is an example of a transfer means transfers the toner image from the photosensitive drum 112*b* toward the intermediary transfer belt 124. The belt scale reading sensor 133*b* which is an example of an electrostatic image index detecting means detects the belt scale 132 on the intermediary transfer belt 124 at a toner image transfer position of the photosensitive drum 112*b*. The controller 150 which is an example of a control means executes alignment of the toner images on the basis of a detection result of the belt scale 132 by the belt scale reading sensor 133*b* and a detection result of an image position mark 15 by an electrostatic image reading sensor 134*b* (potential sensor 330). The toner image transferred on the intermediary transfer belt 124 by the primary transfer roller 104*b* is (positionally) aligned with the toner image on the intermediary transfer belt 124.

At the image forming portion 143*b*, the photosensitive drum 112*b* having the same diameter as that at the image forming portion 143*a* and the belt scale reading sensor 133*b* is disposed at the inner surface of the intermediary transfer belt 124. By such a constitution, the belt scale 132 transferred on the charge receiving portion 125 is detected from the inner surface side of the intermediary transfer belt 124.

With an exposure range protruded from an associated end portion of the intermediary transfer belt 124 at each of the both end portions of the photosensitive drum 112*b*, similarly as in the image forming portion 143*a*, the electrostatic latent image scale lines 131*b* formed simultaneously with the image formed at the image forming portion 143*b* is disposed. The electrostatic latent image reading sensor 134*b* for reading the electrostatic latent image scale lines 131*a* is disposed at a position extended in a photosensitive drum axial direction from a transfer position (transfer line) where the lower side of the photosensitive drum 112*b* and the intermediary transfer belt 124 contact each thereto effect the toner image transfer.

At the image forming portion 143*b*, the belt scale reading sensor 133*b* and the electrostatic latent image reading sensor 134*b* are disposed on the same transfer line. Therefore, it is possible to simultaneously read the electrostatic latent image scale lines 131*b* on the photosensitive drum 112*b* and the belt scale 132 transferred on the charge receiving portion 125 provided on the intermediary transfer belt 124. The electrostatic latent image scale reading sensor 134*b* and the belt scale reading sensor 133*b* have the same constitution and are an antenna (type) potential sensor capable of detecting a potential change of a moving detection surface.

<Potential Sensor>

Figure 6:
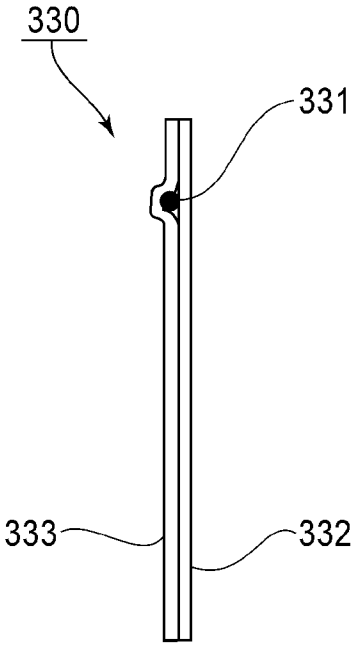
FIG. 6 is an illustration of a cross-sectional structure of the potential sensor taken along E-E line indicated in FIG. 5.
Figure 5:
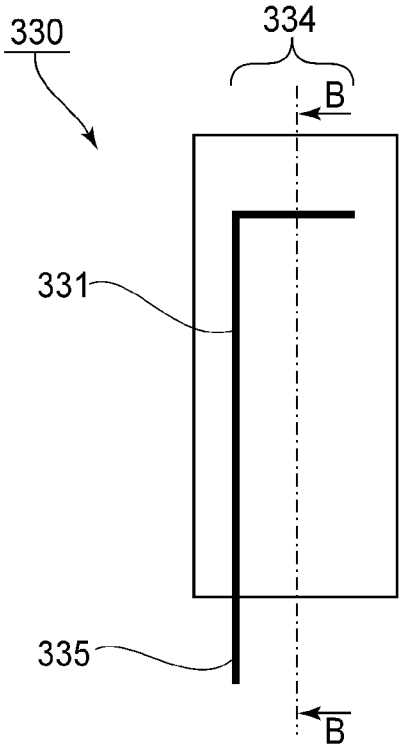
FIG. 5 is an illustration of a planar structure of a potential sensor.
Figure 8:
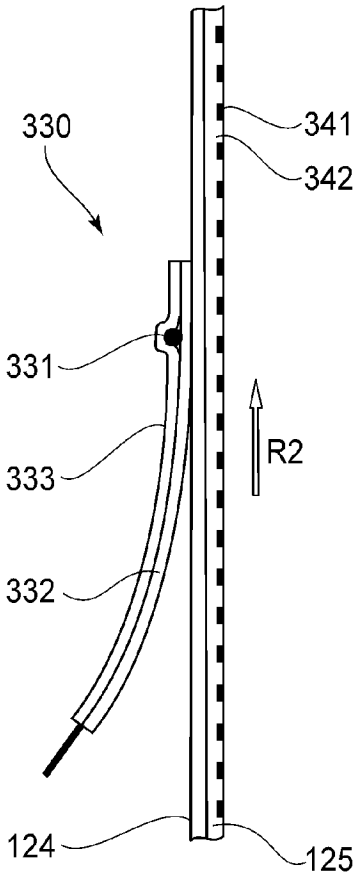
FIG. 8 is a side view for illustrating the detection of the belt scale on the charge receiving portion.
Figure 7:
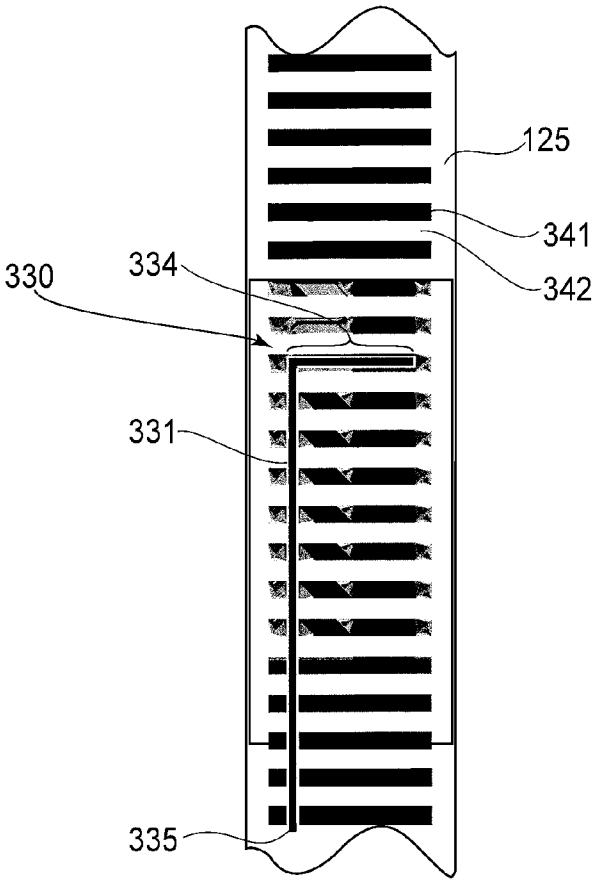
FIG. 7 is a plan view for illustrating detection of a belt scale on the charge receiving portion.

FIG. 5 is an illustration of a planar structure of a potential sensor. FIG. 6 is an illustration of a cross-sectional structure of the potential sensor taken along E-E line indicated in FIG. 5. FIG. 7 is a plan view for illustrating detection of a belt scale on the charge receiving portion. FIG. 8 is a side view for illustrating the detection of the belt scale on the charge receiving portion.

As shown in FIG. 5, the potential sensor 330 includes the lead wire 331 which is consisting of a metal wire of 20 μm in diameter and is bent in an L-shape to provide a detecting portion 334 at its end portion. A length of the detecting portion 334 is about 2 mm. An end portion opposite from the detecting portion 334 of the L-shaped lead wire 331 is an output portion 335 of a signal.

As shown in FIG. 6, the lead wire 331 bent in the L-shape is disposed on a base film 332 formed with a polyimide film of 4 mm in width, 15 mm in height and 25 μm in thickness after an adhesive is applied onto the base film 332. Thereon, a protective film 333 formed with a polyimide film having the same size and thickness as those of the base film 332 is bonded.

The adhesive is present principally between the base film 332 and the protective film 333. The adhesive is not present between the lead wire 331 and the base film 332 and between the lead wire 331 and the protective film 333, so that a distance between the surface of the lead wire 331 and the surface of the base film 332 or the protective film 333 is 25 μm.

As shown in FIG. 7, a region of a high-potential portion 341 where the potential transferred on the charge receiving portion 125 is relatively high is indicated by black and a region of a low-potential portion 342 where the potential is relatively low is indicated as white. In the case where the potential sensor 330 is used as the belt scale reading sensor 133, the potential sensor 330 is fixed so that the detecting portion 334 and the scale lines of the charge receiving portion 125 constituted by the electric charges are parallel to each other.

As shown in FIG. 8, in order to bring the base film 332 of the lead wire 331 into contact with the charge receiving portion 125, the potential sensor 330 is bent and disposed by an unshown supporting portion. In this case, in order to keep a spacing between the detecting portion 334 and the charge receiving portion 125 at a constant value, as shown in FIG. 14, the lead wire 331 may also be pressed by a spring from above the protective film 333.

As shown in FIG. 4, the case where the electrostatic latent image scale lines 131*b* of the photosensitive drum 112*b* are read by the electrostatic latent image scale reading sensor 134*b* consisting of the potential sensor 330 is also similarly constituted. In the case where the potential sensor 330 is used as the electrostatic latent image scale reading sensor 134*b*, the potential sensor 330 is fixed so that the detecting portion 334 and the scale lines, on the photosensitive drum 112*b*, constituted by the electric charges are parallel to each other.

The potential sensor 330 which is an example of the detecting means electrically detects image position marks 8 and 15, which are an example of a second electrostatic image, formed outside the image region of the photosensitive drum 112*b* with respect to the main scan direction by using the exposure device 116*b* while sliding on the photosensitive drum 112*b*. The alignment of the toner image formed in the image region of the photosensitive drum 112*b* is executed on the basis of a detection result of the image mark 15 by the potential sensor 330.

<Positional Alignment of Toner Image>

Figure 9:
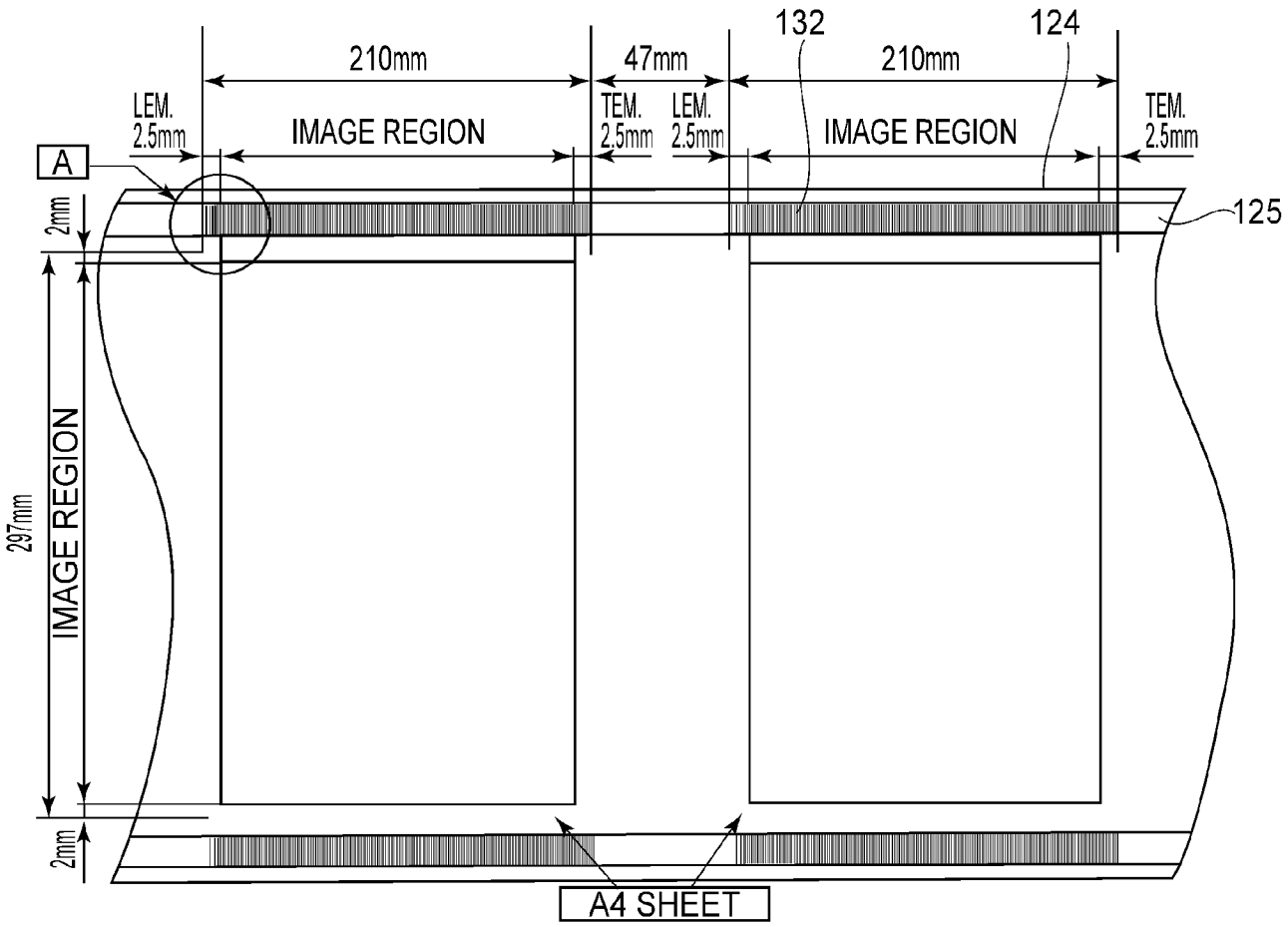
FIG. 9 is an illustration of arrangement of a toner image and the belt scale on the intermediary transfer belt.
Figure 10:
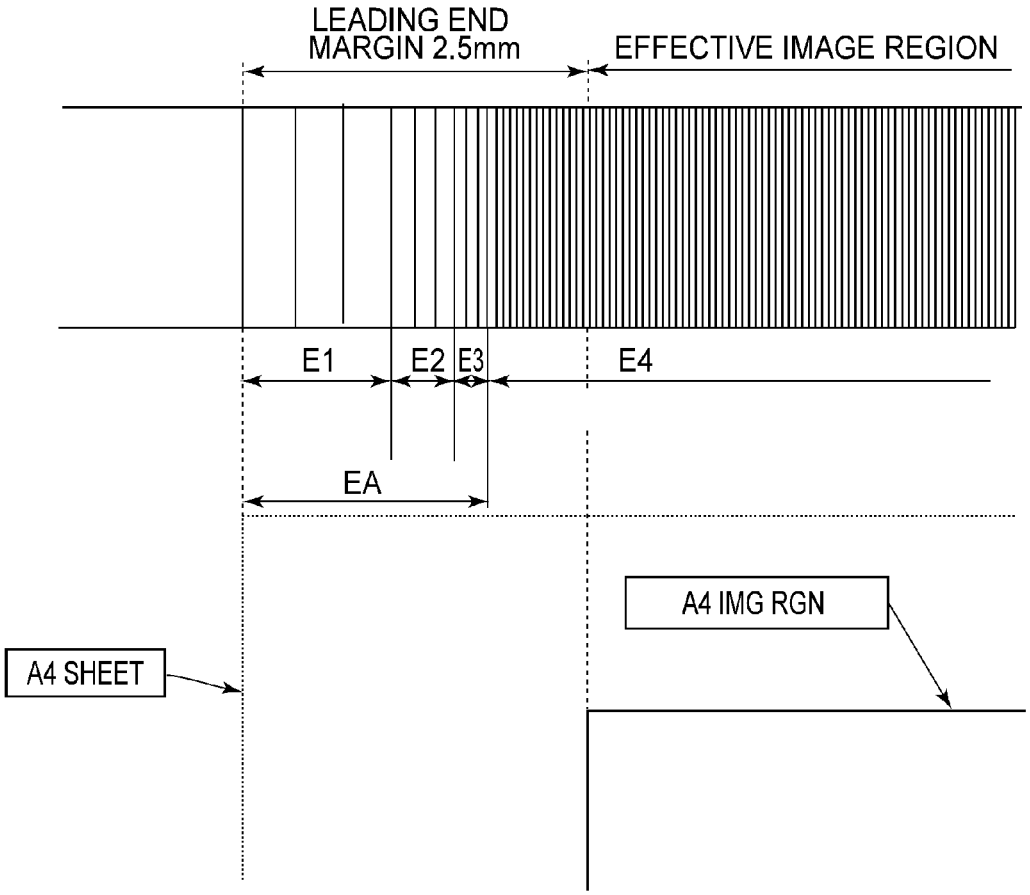
FIG. 10 is an illustration of the belt scale at a first leading end portion indicated by "A" in FIG. 9.
Figure 11:
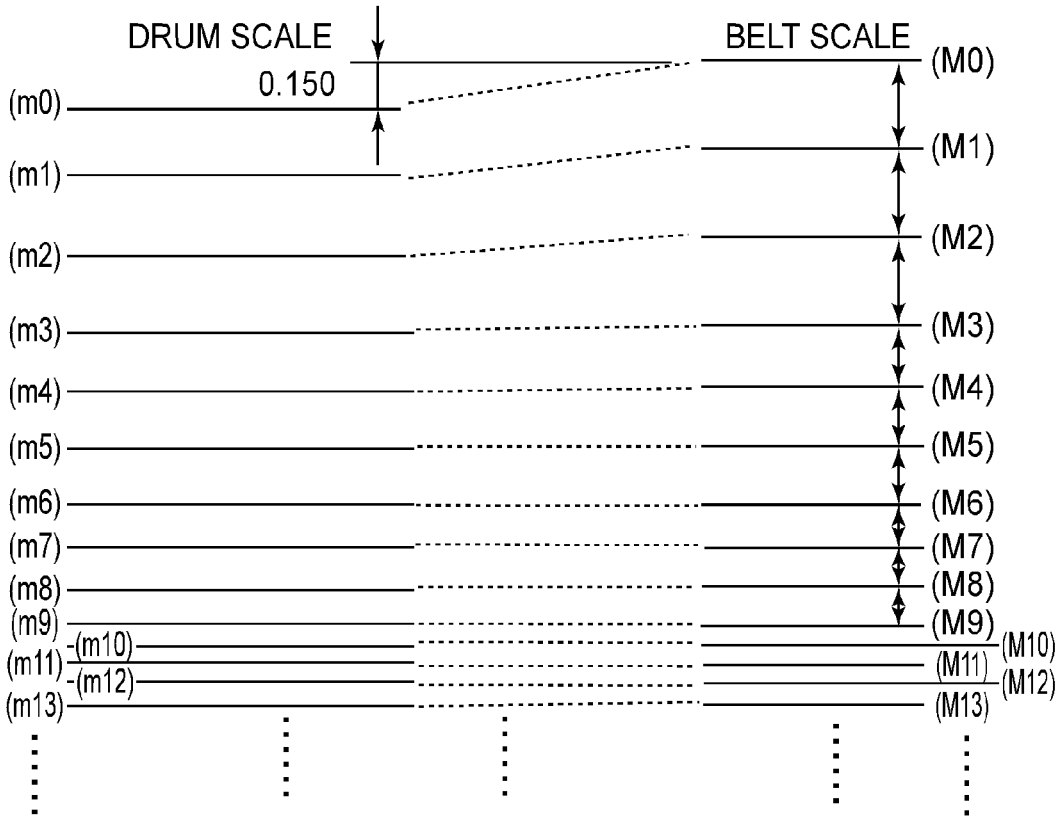
FIG. 11 is an illustration of alignment of electrostatic image scale lines of a photosensitive drum with the belt scale of the intermediary transfer belt.

FIG. 9 is an illustration of arrangement of a toner image and the belt scale on the intermediary transfer belt. FIG. 10 is an illustration of the belt scale at a first leading end portion indicated by "A" in FIG. 9. FIG. 11 is an illustration of alignment of electrostatic image scale lines of a photosensitive drum with the belt scale of the intermediary transfer belt.

As shown in FIG. 9, on the photosensitive drum 112*a*, the toner image for the image to be formed on an A4-sized sheet (landscape orientation) and the electrostatic latent image scale lines 131*a* are formed in a region corresponding to continuous 2 pages. As shown in FIG. 9, on the intermediary transfer belt 124, the toner image for the image and the electrostatic latent image scale lines 131*a* are transferred as they are in the region corresponding to the continuous 2 pages, thus being formed. As shown in FIG. 10, at the image forming portion 143*b*, with respect to each of the lines of the belt scale 132 of the intermediary transfer belt 124, the corresponding electrostatic latent image scale lines 131*b* formed on the photosensitive drum 112*b* are aligned in real time.

As shown in FIG. 9, with respect to the A4 landscape recording material P, the image formation cannot be always effected on the whole surface but is effected with margins at leading, trailing, left and right end portions. The margins at the leading and trailing end portions are 2.5 mm, and the margins at the left and right end portions are 2.0 mm. When the image formation for one page is effected on the photosensitive drum 112*a* at the image forming portion 143*a*, the exposure operation is started from a portion corresponding to the leading end of the recording material P. In this case, from the position of 2.5 mm before the formation region of the toner image, formation of the electrostatic latent image scale lines 131*a* at the both end portion of the photosensitive drum 112*a* is started.

Further, in order to perform scale alignment of the leading end at the image forming portion 143*b* or later with reliability, at the leading end portion margin when the image formation for one page is effected, the exposure operation is performed so that the scale with a pitch larger than that in the effective image region is formed.

As shown in FIG. 10, the scale lines are formed at a portion corresponding to the leading end portion of the margin, so that 4 scale lines with the pitch which is 8 times the scale pitch in the effective image region are formed. Thereafter, 3 scale lines with the pitch which is ½ of the pitch for the 4 scale lines are formed and then 3 scale lines with the pitch which is ½ of the pitch for the preceding 3 scale lines are formed. Thereafter, scale lines with the same pitch as that in the effective image region are formed until the trailing end portion margin region.

FIG. 11 shows an image of the scale alignment control in the case where the leading end of the drum scale is deviated from the belt scale. The leading scale line is deviated and therefore in order to align the subsequent scales with each other, the rotational speed of the drum driving motor 106*b* is changed on the basis of a reading result of the positions of the respective scales, so that the photosensitive drum 112*b* is operated so as to positionally align the subsequent scale lines (m1) and (M1) with each other. However, a positional error is excessively large, so that the scale lines (m1) and (M1) are not completely aligned with each other. Then, when the rotation control of the drum driving motor 106*b* is effected so as to positionally align the scale lines (m2) and (M2) with each other and positionally align the scale lines (m3) and (M3) with each other, positions of the scale lines can be substantially aligned with each other. Thereafter, even when the scale pitch is decreased, the positions of the drum sale and the belt scale can be continuously aligned with each other. This is also true for the minimum scale pitch.

As a result, from the leading end of the effective image, the drum scale can be positionally aligned with the belt scale. That is, with respect to the toner image transferred from the photosensitive drum 112*a* on the intermediary transfer belt 124 at the image forming portion 143*a*, at each of the image forming portions 143*b*, 143*c* and 143*d*, the toner image can be transferred onto the intermediary transfer belt 124 with less color misregistration.

Incidentally, as shown in FIG. 1, when the second electrostatic image for color misregistration adjustment is formed on the photosensitive drum 112*a* and then is developed with the toner at the image portion by the developing device 118*a*, there is a possibility that the toner which is not subjected to the development at the image portion is deposited also on the second electrostatic image. There is a possibility that the toner, of the toner located at the end portion of the image portion (image region), which is laterally moved without being moved toward the photosensitive drum is deposited on the second electrostatic image. Hereinafter, such a toner is referred to as a scattering toner. When the scattering toner is deposited on the second electrostatic image, an electric charge state of the scattering toner is changed, so that the signal detected by the potential sensor 330 becomes unstable.

Therefore, in the following embodiments, a third electrostatic image is formed between the image region and the second electrostatic image and the toner which is not detected on the image region is collected by the third electrostatic image, so that toner deposition on the second electrostatic image is prevented.

Embodiment 1

Parts (a) and (b) of FIG. 12 are illustrations of an image forming portion 143*a* for transferring an image position mark (electrostatic latent image scale lines 131) on the intermediary transfer belt 124. FIG. 13 is an illustration of a constitution of the image forming portion 143*b* in which the image position mark (electrostatic latent image scale lines 131) is detected to effect alignment of the toner image. FIG. 14 is an illustration of reading of the image position mark (electrostatic latent image scale lines 131*a*) on the photosensitive drum 112*b*. As shown in (a) of FIG. 12, the developing device 118*a* includes a developing sleeve 1 opposed to the photosensitive drum 112*a*. The developing device 118*a* is constituted to effect non-contact two-component development, and a gap is formed between the developing sleeve 1 and the photosensitive drum 112*a*. A two-component developer 3 is only illustrated at a portion opposing the photosensitive drum 112*a* but is actually carried on the substantially full circumference of the developing sleeve 1.

A region between broken lines 4*a* and 4*b* of the developing sleeve 1 is a coating region 6 where the electrostatic image can be developed into the toner image. The two-component developer 3 is deposited on the surface of the developing sleeve 1 only in the coating region 6. Inside the developing sleeve 1, an unshown magnet roller is provided so as to range between the broken lines 4*a* and 4*b*, thus defining the coating region 6 of the two-component developer 3.

An effective image region 30 where the electrostatic latent image for the image is formed is located somewhat inside the both ends of the coating region 6 on the surface of the developing sleeve 6. A region outside each of broken lines 7*a* and 7*b* of the photosensitive drum 112*a* is an image position mark formation region 11 where the image position mark 8 for the second electrostatic image is formed.

A toner collection mark formation region 9 where a toner collection mark for the third electrostatic image is formed is located between the broken lines 4*a* and 7*a* and between the broken lines 4*b* and 7*b*. The toner collection mark formation region 9 is provided between the coating region 6 and the image position mark formation region 11.

When the toner image is formed in the effective image region 30, first, the surface of the photosensitive layer of the photosensitive drum 112*a* is uniformly charged to about −600 V by the charging roller 114*a*. The charging roller 114*a* is constituted so that it is capable of charging a full width of the photosensitive drum 112*a*. In this case, the toner collection mark formation region 9 and the image position mark formation region 11 are also, similarly as in the effective image region 30, uniformly charged to about −600 V by the charging roller 114*a*.

Next, by the exposure device 116*a*, the surface of the photosensitive drum 112*a* is scanned with the laser light in accordance with the image signal, so that the surface potential of the portion irradiated with the laser light is changed to about −100 V. At the surface potential of about −100 V, the first electrostatic image depending on the image data, the third electrostatic image for the toner collection mark 10 and the second electrostatic image for the image position mark 8 are formed in the effective image region 30, the toner collection mark formation region 9 and the image position mark formation region 11, respectively.

As shown in (b) of FIG. 12, in the effective image region 30 of the photosensitive drum 112*a*, the electrostatic image for a whole-surface maximum density image providing the toner image is formed. Outside the coating region 6 of the photosensitive drum 112*a*, the third electrostatic image for forming the toner collection mark 10 is continuously formed with respect to the sub-scan direction. Outside the toner collection mark formation region 9 of the photosensitive drum 112*a*, the image position mark of which is an example of the second electrostatic image is formed. The writing of the toner collection mark 10 and the image position mark 8 are continued from immediately after the start of the rotational drive of the photosensitive drum 112*a* until the image formation on the photosensitive drum 112*a* is ended.

Thereafter, when the developer reaches the opposing portion to the developing sleeve located downstream of the exposure portion of the exposure device 116*a*, the toner is separated from the carrier to develop the electrostatic image corresponding to the toner image. An oscillating voltage in the form of a DC voltage biased with an AC voltage is applied between the photosensitive drum 112*a* and the whole surface of the developing sleeve 1 in the effective image region 30, so that the toner is separated from the carrier to be moved toward the photosensitive drum 112*a* and thus develops the electrostatic image for the image into the toner image.

In this case, most of the toner moved from the developing sleeve 1 onto the photosensitive drum 112*a* is deposited on the electrostatic image for the image formed on the effective image region 30 but the toner which is not subjected to the development and is suspended in their gap is also present. Of the suspended toner, there is a possibility that the toner close to the end portion of the coating region 6 is moved toward the image position mark 8. Further, there is a possibility that the toner at the end portion of the developing sleeve 1 is scattered laterally toward the outside of the coating region 6.

However, in Embodiment 1, the surface potential of the toner collection mark 10 is set at a value equal to that of the electrostatic image for the image so that the charged toner scattered to the outside without developing the electrostatic image for the image formed in the effective image region 30 is electrostatically deposited. The surface potential of the toner collection mark 10 after the exposure is −100 V which is the same as that of the electrostatic image for the image in the effective image region 30, thus being capable of attracting the toner. Therefore, when the toner moved to the outside of the coating region 6 reaches the toner collection mark 10, the toner is subjected to the development and is trapped by the toner collection mark 10, so that the toner is not moved to the outside further.

The toner T is attracted in a large amount to a portion where the electric field is strong and therefore is concentrated at an edge portion of the toner collection mark 10. When the edge portion is formed in a large amount, the toner is move easy to be collected. Therefore, by forming the toner collection mark 10 in a large amount, the toner can be collected efficiently. For this reason, it is desirable that a plurality of toner collection marks 10 are disposed in parallel with respect to the main scan direction. Further, in order to collect the scattering toner with reliability, it is desirable that the toner collection mark 10 is not interrupted with respect to the sub-scan direction in the region where the toner image for the image is present with respect to the sub-scan direction. For the above reasons, in Embodiment 1, the toner collection mark 10 is formed so that three parallel lines extending in the sub-scan direction are formed. The plurality of the toner collection marks 10 arranged in the main scan direction of the photosensitive drum 112*a* are formed.

Each of between the coating region 6 and the toner collection mark 10 and between the toner collection mark 10 and the image position mark 8, a non-exposure portion is provided, so that a region where the toner is not subjected to the development is provided. Therefore, the toner to be subjected to the development at the end portion of the effective image region 30 is prevented from being accidentally moved to the toner collection mark 10, and the toner intended to be trapped by the toner collection mark 10 is prevented from being deposited on the image position mark 8.

In order to collect the scattering toner with reliability and in order to prevent the scattering toner from reaching the image position mark 8, it is desirable that the toner is easy to be deposited on the toner collection mark 10 more than the image position mark 8. Therefore, a developing contrast for the toner collection mark 10 may preferably be set at a value larger than that for the image position mark 8. In the reversal development, the surface potential of the toner collection mark 10 may preferably be set at a smaller absolute value, at which the toner is easy to be deposited, in such a manner that the surface potential of the toner collection mark 10 is set at −90 V or −80 V when the surface potential of the image position mark 8 is −100 V.

In the case of the reversal development in which the toner is subjected to the development at the exposure portion, the surface potential of the toner collection mark 10 may preferably be set at a value which is equal to or more than that of the electrostatic image for the image in view of an operation environment, change with time, variation and the like of the image forming apparatus 100. The surface potential of the toner collection mark 10 may preferably be set at a value smaller in absolute value than the surface potential of the image position mark 8.

The toner subjected to the development of the toner collection mark 10 on the surface of the photosensitive drum 112*a* and the toner which is subjected to the development in the effective image region 30 and is not transferred onto the intermediary transfer belt 124 is, as shown in FIG. 1, scraped off by the drum cleaning device 122*a*. The cleaning blade of the drum cleaning device 122*a* is formed in a plate-like shape by an elastic material such as urethane or the like, and a length thereof with respect to a longitudinal direction is set at a value more than a length 29 including the toner collection mark 10 shown in (a) of FIG. 12.

The drum cleaning device 122*a* may also be replaced with a cleaning device using a cleaning roller. The cleaning roller formed of an elastic material is press-contacted to the photosensitive drum 112*a*, and a voltage of a polarity opposite to the toner charge polarity is applied to the cleaning roller, so that a residual toner on the surface of the photosensitive drum 112*a* is collected. Also in this case, a width of the cleaning roller is required to be not less than the length 29 including the toner collection mark 10 shown in (a) of FIG. 12.

As shown in FIG. 13, at the image forming portions 142*b*, 142*c* and 142*d*, the image position mark 15 (=electrostatic latent image scale lines 131*b*) is read by the potential sensor 330, so that the rotational speeds of the photosensitive drums 112*b*, 112*c* and 112*d* are controlled in real time. At the image forming portions 143*a*, 143*c* and 143*d*, the coating region 6 and the toner collection mark formation region 9 have the same position and width as those at the image forming portion 143*a*. The image position mark 15 is disposed outside the image position mark 8 correspondingly to a distance 13 between the broken lines 7*a* and 12*a* and between the broken lines 7*b* and 12*b*. The region between the broken lines 7*a* and 12*a* and between the broken lines 7*b* and 12*b* is a region where the image position mark 8 at the image forming portion 143*a* is transferred onto the intermediary transfer belt 124.

When the toner is subjected to the development in the region between the broken lines 7*a* and 12*a* and the region between the broken lines 7*b* and 12*b*, there is a possibility that the toner is transferred onto the belt scale 132 transferred on the intermediary transfer belt 124. In order to prevent this transfer, toner collection marks 14 are provided in the region between the broken lines 4*a* and 7*a* and the region between the broken lines 4*b* and 7*b*. These toner collection marks 14 have the same shape and function as those on the photosensitive drum 112*a* at the image forming portion 143*a*.

Each of the electrostatic images in the effective image region 30 and as the toner collection marks 14 and image position marks 15 are, similarly as those at the image forming portion 143*a*, provided independently with the non-exposure portion interposed therebetween. Similarly as at the image forming portion 143*a*, the toner is subjected to development of the electrostatic image for the image in the effective image region 30. In this case, the scattering toner is subjected to development of the toner collection mark 14 but therefore the toner does not reach the image position mark 15.

As shown in FIG. 14, at the image forming portion 143*b*, the image position mark 15 (=electrostatic latent image scale lines 131*b*) is read by the potential sensor 330, so that the rotational speed of the photosensitive drum 112*b* is controlled in real time. With respect to the image position mark 15 on the photosensitive drum 112*b*, a high-potential portion 241 where the potential of the photosensitive drum 112*b* charged by the charging roller 114*b* is relatively high is indicated by black and a low-potential portion 242 where the potential of the photosensitive drum 112*b* exposed to light by the exposure device 116*b* is indicated as white.

In order to bring the base film 332 of the lead wire 33*a* into contact with the photosensitive drum 112*b*, the potential sensor 330 is bent and is held by an unshown supporting portion. In this case, in order to always keep a spacing between the photosensitive drum 112*b* and the lead wire 331 constituting the detecting portion at a constant value, the lead wire 331 is urged toward the photosensitive drum 112*b* from above (from below in FIG. 14) the protective film 333 by a compression spring 27. The compression spring 27 urges the potential sensor 330 toward the photosensitive drum 112*b*.

The exposure device 116*b* which is an example of the third electrostatic image forming means forms the toner collection mark 14, which is an example of the third electrostatic image, outside the image region with respect to the main scan direction of the photosensitive drum 112*b* and inside the image position mark 15. The toner collection mark 14 is not detected by the potential sensor 330. The exposure device 116*b* continuously forms the electrostatic image for the image, the third electrostatic image and the second electrostatic image with respect to the main scan direction. The exposure device 116*b* provides a toner detection-enable potential to the electrostatic image for the image, the toner collection mark 14 and the image position mark 15.

In Embodiment 1, the toner collection mark formation region 9 is formed inside the image position mark formation region 11 constituting the image position mark 151 (=electrostatic latent image scale lines 131*b*) and therefore it is possible to prevent the toner from being deposited on the image position mark 15. Therefore, it is possible to prevent fluctuation of the spacing between the lead wire 331 and the photosensitive drum 112*b* due to the presence of the toner particles sandwiched at the contact surface between the potential sensor 330 and the photosensitive drum 112*b*. A contact state between the potential sensor 330 and the photosensitive drum 112*b* is kept at a constant level, so that a stable detection signal can be obtained.

In a color electrophotographic image forming apparatus using an electrophotographic recording process, such as a color printer or a color copying machine, particularly in the image forming apparatus including a plurality of image forming portions, it becomes possible to reduce a degree of the color misregistration with respect to a conveyance direction to enable high-quality image output.

In Embodiment 1, by using the exposure devices 116*a* and 116*b* for writing the electrostatic image for the image, the image position mark 15 and the toner collection marks 10 and 14 were written (formed) on the same scanning line at the same time. However, a dedicated LED light source for recording the toner collection marks 10 and 14 may also be provided between the charging position and the exposure position.

Embodiment 2

FIG. 15 is an illustration of a toner collection mark in Embodiment 2. Parts (a) to (c) of FIG. 16 are illustrations of arrangement of the toner collection mark. As shown in (a) of FIG. 12, in Embodiment 1, each of the toner collection marks 10 and 14 were constituted by three ring-like electrostatic images continuously extending in the sub-scan direction. On the other hand, a toner collection mark 16 is formed in another shape.

As shown in FIG. 15, the toner collection mark 16 is constituted in a shape such that each line of the toner collection mark 10 is divided into many portions with respect to the sub-scan direction. As described above, the toner was concentrated at the strong electric field portion and therefore was attracted to the edge portion of the toner collection mark.

Therefore, as shown in FIG. 15, the toner collection mark was divided in the sub-scan direction to create many edge portions, so that the toner is collected efficiently more than in Embodiment 1. With respect to the plurality of the toner collection marks 16 arranged in the main scan direction, they are spaced so as not to overlap with each other with respect to the main scan direction.

Further, the toner collection marks 16 may also be divided into portions which are larger in number than that of the portions shown in FIG. 15 within a range in which they are not substantially interrupted with respect to the sub-scan direction. A constitution in which the toner collection marks 16 are disposed at a high density to the possible extent without changing the width of the toner collection mark formation region 9 may be employed.

In (a), (b) and (c) of FIG. 16, toner collection marks 17 in the toner collection mark formation region 9 are shown in an enlarged manner. A line-and-space pattern is repeated with respect to the sub-scan direction in order that the toner collection marks are not substantially interrupted with respect to the sub-scan direction while increasing the edge portions thereof. For this reason, the scattering toner can be further efficiently collected compared with the pattern of FIG. 15.

Embodiment 3

Parts (a) and (b) of FIG. 17 are illustrations of a toner collection mark in Embodiment 3. As shown in (a) of FIG. 12, in Embodiment 1, the three lines of each of the toner collection marks 10 and 14 were formed to have the same potential. On the other hand, in Embodiment 3, three lines of the toner collection mark 10 are formed to have potentials different from each other.

As shown in (a) of FIG. 17, the maximum density toner image is carried on the photosensitive drum 112*a* in the effective image region 30.

Each of the toner collection marks 10 is electrostatic images formed in ring-shaped three lines each continuously extending in the sub-scan direction. The three toner collection marks 10 are, as shown at a portion 28 shown in (b) of FIG. 17, gradually increased in potential from the toner collection mark 10 closer to the effective image region 30. The potentials of the three toner collection marks 10 were set at about −100 V substantially equal to that in the effective image region 30. With respect to the plurality of toner collection marks 14 arranged in the main scan direction of the photosensitive drum 112*b*, the potential at which the toner can be deposited in a larger amount is provided the toner collection mark 14 closer to the image position mark 15.

The potential of the toner collection mark 10 closest to the effective image region 30 was made smaller than that in the effective image region 30, so that the toner collection mark 10 did not influence the toner to be deposited on the effective image region 30. This is because when the toner collection mark 10 having the same potential as that in the effective image region 30 is formed in the neighborhood of a boundary of the effective image region 30, depending on a distance from the boundary, also the toner to be deposited in the effective image region 30 is attracted to the toner collection mark 10. The potentials of the toner collection marks 10 are gradually (stepwisely) increased toward the outside image position mark 8, so that the potential of the toner collection mark 10 closest to the image position mark 8 is made higher than the potential in the effective image region 30. Thus, by providing the high-potential portion, it becomes possible to collect the toner suspended at a position apart from the photosensitive drum 112*b* and a weakly charged toner. The potentials of the toner collection marks 10 may desirably be set depending on a distance from the effective image region 30.

Embodiment 4

FIG. 18 is an illustration of arrangement of the toner collection mark on one-full-circumference of the photosensitive drum with respect to a sub-scan direction. FIG. 19 is an illustration of arrangement of the toner collection mark associated with (corresponding to) a length of an effective image region with respect to the sub-scan direction. FIG. 20 is an illustration of arrangement of the toner collection mark associated with (corresponding to) a length of an first position mark with respect to the sub-scan direction.

In FIGS. 18, 19 and 20, the photosensitive drum 112*a* is developed in the sub-scan direction to show an arrangement relation among toner collection marks 10, effective image regions 30 and image position marks 8. The state in which the toner image for the image to be formed on the A4 landscape sheet on the photosensitive drum 112*a* at the image forming portion 143*a*, the belt scales 8 and the toner collection marks 10 are transferred corresponding to the continuous 2 pages is developed in a plane. The margins of the leading, trailing, left and right end portions of the A4 landscape recording material are as already described above.

When the image formation for one page is effected on the photosensitive drum 112*a*, the exposure operation is started from a portion corresponding to the leading end of the recording material and formation of the image position mark 8 at both end portions of the photosensitive drum 112*a* is started from a position which is 2.5 mm before the toner image formation region. With respect to the pitches of the image position marks 8, as already described above, they are formed at the leading end margin portion with a pitch larger than that in the image region and are then gradually decreased in pitch.

As shown in FIG. 18, in Embodiment 1, the toner collection marks 10 and the image position marks 8 are formed until the outside positions of the image region with respect to the sub-scan direction of the develop 112*b*. The toner collection marks 10 continuous with respect to the sub-scan direction of the photosensitive drum 112*b* are formed so as to separate the image position marks 8, from the image region, arranged in the sub-scan direction of the photosensitive drum 112*b*. The toner collection marks 10 are always formed. Each toner collection mark 10 was constituted by three ring-like electrostatic images extending one-full-circumference continuously in the sub-scan direction of the photosensitive drum 112*a*. The toner collection mark 10 is formed continuously not on only the portion of the image position mark 8 but also at other portions without being interrupted during continuous printing. By forming the toner collection mark 10 in this way, the toner deposition on the image position marks 8 can be prevented with reliability. The toner collection mark 10 is always formed and therefore the toner scattered from an unexpected direction can also be collected with reliability.

A shown in FIG. 19, in Embodiment 4A, the toner collection mark 10 is provided correspondingly to the range of the toner image. The toner collection mark 10 was constituted by a linear electrostatic image extending continuously in a length corresponding to the length of the toner image portion 31, with respect to the sub-scan direction, formed in the effective image region.

The toner collection mark 10 is formed in a region corresponding to a region, ranging from the leading end to the trailing end of the toner image portion 31, which is a range where the image data is present (a range where the toner is deposited). With respect to the sub-scan direction, timing of start and end of the exposure at the toner image portion 31 by the exposure device 116*a* is recognized in advance, and then the toner collection mark 10 is formed from a position somewhat before the leading end of the toner image portion 31 to a position somewhat after the trailing end of the toner image portion 31. In this method, the arrangement of the toner collection mark 10 is changed every one sheet, and the range of the toner collection mark 10 is a necessary minimum range. The scattering toner is generated from the toner image portion 31 and therefore when the toner collection mark 10 is formed in this way, the scattering toner can be collected.

As shown in FIG. 20, in Embodiment 4B, the toner collection mark 10 is formed correspondingly to the range of the image position mark 8. The toner collection mark 10 was constituted by the linear electrostatic image extending continuously in a length substantially corresponding to the length of the image position mark 8, with respect to the sub-scan direction, which is somewhat longer than the length of the effective image region with respect to the sub-scan direction. The toner collection mark 10 is formed in the length somewhat longer than the image position mark 8 and is interrupted at a spacing between adjacent pages (sheets). Although the length of the toner collection mark 10 may be substantially equal to the length of the image position mark 8, to make sure, the toner collection mark 10 is formed from a position somewhat before the leading end of the image position mark 8 to a position somewhat after the trailing end of the image position mark 8.

In each of the embodiments shown in FIGS. 18, 19 and 20, the effect of preventing the toner deposition on the image position mark 8 is the same and thus the region of the toner collection mark 10 with respect to the sub-scan direction may only be required to be selected depending on an estimated amount of the scattering toner. In the case where there is a possibility that the toner movement toward the outside of the image position mark 8 in a sheet interval of consecutive sheets during the continuous printing, the arrangement as shown in FIG. 19 is employed. In the case where the toner movement is prevented only when the toner is subjected to development in the print region, the arrangement as shown in FIG. 18 or 20 may be employed.

Further, depending on a print status, the arrangements in the embodiments shown in FIGS. 18, 19 and 20 may appropriately be selectable. For example, when the image is printed continuously on a large number of sheets, the toner collection mark 10 may be formed in a minimum region as shown in FIG. 19. When the number of sheets is small or when low-duty printing is mode, the toner collection mark 10 is formed in the pattern as shown in FIG. 20 or FIG. 18.

Embodiment 5

As described in JP-A Hei 10-39571, in order to adjust a writing start position of the electrostatic image on the photosensitive drum in advance of image formation, the second electrostatic image may be formed. Also in this case, it is possible to avoid unnecessary development of the second electrostatic image by providing the third electrostatic image between the effective image region and the second electrostatic image.

As shown in FIG. 1, before the image formation, at the image forming portions 143*a*, 143*b*, 143*c* and 143*d*, the four second electrostatic images are formed simultaneously and are transferred onto the charge receiving portion 125 on the intermediary transfer belt 124. Then, in a downstream side of the image forming portion 143*d*, a time difference in detection time among the four second electrostatic images at the charge receiving portion 125 is measured. The writing start timing of the electrostatic image at each of the image forming portions 143*a*, 143*b*, 143*c* and 143*d* is adjusted so as to provide the same time difference.

As described above, in the image forming apparatus of the present invention, even when the toner is scattered to the outside during the development of the first electrostatic image in the image region, the toner is trapped by the third electrostatic image and does not readily reach the second electrostatic image and therefore the detecting means can detect the second electrostatic image in a state in which the toner is not deposited on the second electrostatic image.

Therefore, even when the second electrostatic image is disposed at the position close to the image region, the toner is not readily deposited on the second electrostatic image when the electrostatic image in the image region is developed into the toner image. For this reason, the operation of the contact potential sensor is stabilized, so that the positional alignment of the toner images using the electrostatic image for the positional alignment can be precisely effected.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 123177/2011 filed Jun. 1, 2011, which is hereby incorporated by reference.

What is claimed is:

1. An image forming apparatus, comprising:

a first image bearing member;

a second image bearing member;

a developing device for forming a toner image on the basis of an electrostatic latent image formed on said first image bearing member;

electrostatic latent image forming means for forming an electrostatic latent image mark on said first image bearing member;

detecting means for detecting a position of the electrostatic latent image mark; and an adjusting portion for adjusting, on the basis of a detection result of the position of the electrostatic latent image mark, superposition between the toner image formed on said first image bearing member and a toner image formed on said second image bearing member, wherein an electrostatic latent image which is undetectable by said detecting means is formed between a formation region of the toner image on said first image bearing member and a formation region of the electrostatic latent image mark on said first image bearing member.

2. An apparatus according to claim 1, wherein a surface potential between the toner image formation region and the electrostatic latent image mark formation region is the same as a surface potential of the electrostatic latent image developed with a toner in the toner image formation region.

3. An apparatus according to claim 1, wherein the electrostatic latent image between the toner image formation region and the electrostatic latent image mark formation region is a plurality of line images along a circumferential direction of said first image bearing member.

4. An apparatus according to claim 3, wherein a polarity of the electrostatic latent image is the same as a normal charge polarity of the toner, and wherein an absolute value of a surface potential of the line image, of the plurality of line members, close to the electrostatic latent image mark formation region is smaller than an absolute value of a surface potential of the line image close to the toner image formation region.

5. An apparatus according to claim 1, further comprising:

an intermediary transfer member for superposedly carrying the toner image formed on said first image bearing member and the toner image formed on said second image bearing member; and transfer means for transferring the electrostatic latent image mark from said first image bearing member onto said intermediary transfer member, wherein said detecting means detects the electrostatic latent image mark transferred on the intermediary transfer member.

* * * * *